US010618302B2

(12) United States Patent
Sato et al.

(10) Patent No.: US 10,618,302 B2
(45) Date of Patent: Apr. 14, 2020

(54) IMAGE-RECORDING APPARATUS INCLUDING CARTRIDGE, TANK, AND DETECTOR FOR DETECTING RESIDUAL AMOUNT OF LIQUID

(71) Applicant: BROTHER KOGYO KABUSHIKI KAISHA, Nagoya-shi, Aichi-ken (JP)

(72) Inventors: Masatake Sato, Nagoya (JP); Hiroaki Takahashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 16/042,787

(22) Filed: Jul. 23, 2018

(65) Prior Publication Data

US 2019/0030909 A1 Jan. 31, 2019

(30) Foreign Application Priority Data

Jul. 31, 2017 (JP) ..... 2017-148279

(51) Int. Cl.
*B41J 2/175* (2006.01)
*B41J 29/38* (2006.01)
(Continued)

(52) U.S. Cl.
CPC ..... *B41J 2/17566* (2013.01); *B41J 2/1752* (2013.01); *B41J 2/17513* (2013.01);
(Continued)

(58) Field of Classification Search
CPC .. B41J 2/17566; B41J 2/1752; B41J 2/17546; B41J 2/17523; B41J 29/02; B41J 29/38;
(Continued)

(56) References Cited

U.S. PATENT DOCUMENTS 5,760,806 A * 6/1998 Oda ..... B41J 2/17513 347/87
5,886,721 A * 3/1999 Fujii ..... B41J 2/17513 347/87

(Continued)

FOREIGN PATENT DOCUMENTS

| | | |
|---|---|---|
| EP | 2 781 358 A1 | 9/2014 |
| JP | 2008-213162 A | 9/2008 |
| JP | 2014-180797 A | 9/2014 |

*Primary Examiner* — Huan H Tran
*Assistant Examiner* — Alexander D Shenderov
(74) *Attorney, Agent, or Firm* — Merchant & Gould P.C.

(57) ABSTRACT

An image-recording apparatus includes: a cartridge including a first storage chamber and a supply port; a tank including a second storage chamber and an inlet port; a connecting portion including a liquid channel providing communication between the supply port and the inlet port; and a detector for detecting whether a liquid level in the second storage chamber is at a prescribed position. The first storage chamber includes an upper space and a lower space partitioned by a wall formed with a communication opening. An inequality of $Pm<\rho \cdot Hs \cdot g - Ic \cdot Rn$ is satisfied, where: Pm: withstand pressure of meniscus formed at the communication opening; P: density of liquid; Hs: vertical length between the prescribed position and the communication opening; g: gravitational acceleration; Ic: flow rate of liquid from the first storage chamber to the second storage chamber; and Rn: passage resistance at the liquid channel.

14 Claims, 11 Drawing Sheets

(51) Int. Cl.
*B41J 29/02* (2006.01)
*B41J 29/13* (2006.01)

(52) U.S. Cl.
CPC ..... *B41J 2/17523* (2013.01); *B41J 2/17526* (2013.01); *B41J 2/17546* (2013.01); *B41J 2/17553* (2013.01); *B41J 2/17596* (2013.01); *B41J 29/02* (2013.01); *B41J 29/13* (2013.01); *B41J 29/38* (2013.01)

(58) Field of Classification Search
CPC .... B41J 2/17553; B41J 29/13; B41J 2/17513; B41J 2/17526; B41J 2/17596
USPC ..... 347/7
See application file for complete search history.

(56) References Cited

U.S. PATENT DOCUMENTS

| | | | | |
|---|---|---|---|---|
| 2004/0189753 | A1* | 9/2004 | Ikezaki | B41J 2/17509 347/85 |
| 2008/0204488 | A1 | 8/2008 | Usui | |
| 2011/0090292 | A1* | 4/2011 | Iwasaki | B41J 2/17509 347/85 |

* cited by examiner

IMAGE-RECORDING APPARATUS INCLUDING CARTRIDGE, TANK, AND DETECTOR FOR DETECTING RESIDUAL AMOUNT OF LIQUID

CROSS REFERENCE TO RELATED APPLICATION

This application claims priorities from Japanese Patent Application No. 2017-148279 filed on Jul. 31, 2017. The entire content of the priority application is incorporated herein by reference.

TECHNICAL FIELD

The present disclosure relates to an image-recording apparatus including a cartridge storing liquid, a tank for storing the liquid supplied from the cartridge, and a head provided with nozzles for ejecting the liquid supplied from the tank.

BACKGROUND

Conventionally, there is known an image-recording apparatus that includes a main tank storing liquid, a sub tank for storing the liquid supplied from the main tank, and a head provide with nozzles for ejecting the liquid supplied from the sub tank. For example, Japanese Patent Application Publication No. 2008-213162 (Reference 1) discloses such an image-recording apparatus in which both of the main tank and the sub tank are open to an atmosphere. Accordingly, when a liquid level of the liquid stored in the sub-tank is lowered due to ejection of the liquid at the head, there is generated a water head difference between a liquid level of the liquid stored in the main tank and the liquid level of the liquid stored in the sub tank. Due to this water head difference, the liquid stored in the main tank is allowed to flow into the sub-tank.

On the other hand, Japanese Patent Application Publication No. 2014-180797 (Reference 2) discloses a liquid cartridge whose liquid chamber is divided into an upper space and a lower space by a partitioning wall. In this liquid cartridge, the partitioning wall is formed with a connecting port through which liquid in the upper space is allowed to flow into the lower space.

SUMMARY

An orientation of an image-recording apparatus may be changed during transportation thereof. For example, while the image-recording apparatus should be used with its lower surface placed on a level surface to serve as a bottom of the image-recording apparatus (operable posture), the image-recording apparatus may be put in a vertical orientation with its rear surface in the operable posture placed on the level surface to serve as the bottom of the image-recording apparatus (rear-surface-down posture). If the image-recording apparatus is disposed in such unintended orientation, a head may be located below a liquid chamber. As a result, the liquid in the liquid chamber may flow into the head, thereby resulting in leakage of ink from the head. In this regard, in the liquid cartridge of Reference 2, the liquid stored in the upper space is less likely to flow into the head even if the orientation of the image-recording apparatus is changed, since the liquid chamber is partitioned by the partitioning wall.

Here, suppose that the structure of the liquid cartridge of Reference 2 is employed as the main tank of the image-recording apparatus disclosed by Reference 1. In this configuration, when the liquid in the liquid cartridge (main tank) flows into the sub tank in the operable posture, a meniscus may be formed at the connecting port formed in the partitioning wall of the liquid cartridge. Such meniscus may interrupt circulation of the liquid from the liquid cartridge toward the sub tank, which may hinder equalization of the liquid levels between the liquid stored in the liquid cartridge and the liquid stored in the sub tank. If the liquid level in the sub tank is detected without being equalized with the liquid level of the liquid stored in the liquid cartridge, such liquid level detection lacks accuracy.

In view of the foregoing, it is an object of the disclosure to provide an image-recording apparatus capable of accurately detecting a liquid level of liquid stored in a tank even if a meniscus is formed in a communication port of a wall defining a liquid chamber of a cartridge.

In order to attain the above and other objects, according to one aspect, the disclosure provides an image-recording apparatus including a cartridge, a tank, a connecting portion, a recording head, and a detector. The cartridge includes: a first storage chamber storing liquid; a liquid supply port through which the liquid in the first storage chamber is allowed to be supplied; and a first air communication portion configured to allow the first storage chamber to communicate with an atmosphere. The tank includes: a liquid inlet port in communication with the first storage chamber through the liquid supply port; a second storage chamber in communication with the communication port and configured to store the liquid supplied from the first storage chamber through the liquid inlet port; a liquid outlet port allowing the liquid stored in the second storage chamber to be discharged therefrom; and a second air communication portion configured to allow the second storage chamber to communicate with the atmosphere. The connecting portion includes a first liquid channel allowing the liquid to circulate between the liquid supply port and the liquid inlet port. The recording head is in communication with the liquid outlet port through a second liquid channel. The recording head includes a nozzle configured to eject the liquid supplied from the liquid outlet port through the second liquid channel. The detector is configured to detect whether or not a level of the liquid stored in the second storage chamber comes to a prescribed position. The first storage chamber is defined by inner surfaces including an inner partitioning surface positioned close to the tank. The first storage chamber is partitioned by a wall portion into an upper space above the wall portion and a lower space below the wall portion. The wall portion extends from the inner partitioning surface in a first direction away from the tank. The wall portion is formed with a communication opening through which the upper space and the lower space communicate with each other. The liquid supply port is in communication with the lower space of the first storage chamber. The prescribed position of the liquid to be detected by the detector is positioned between the communication opening and the liquid supply port in a vertical direction. In this image-recording apparatus, a following inequality (1) is satisfied: $Pm<\rho \cdot Hs \cdot g - Ic \cdot Rn$, in which: Pm is a withstand pressure of meniscus of the liquid formed at the communication opening; P is density of the liquid; Hs is a length in the vertical direction between the prescribed position of the liquid level detected by the detector and the communication opening; g is gravitational acceleration; Ic is a flow rate of the liquid flowing from the first storage chamber to the second storage chamber when a level of the liquid in the first storage chamber is at the communication opening and the level of the liquid in the second storage chamber is at the prescribed position; and Rn is a passage resistance at the first liquid channel.

According to another aspect, there is also provided an image-recording apparatus including a cartridge, a tank, a connecting portion, a recording head, and a detector. The cartridge includes: a first storage chamber storing liquid; a liquid supply port through which the liquid in the first storage chamber is allowed to be supplied; and a first air communication portion configured to allow the first storage chamber to communicate with an atmosphere. The tank includes: a liquid inlet port in communication with the first storage chamber through the liquid supply port; a second storage chamber in communication with the communication port and configured to store the liquid supplied from the first storage chamber through the liquid inlet port; a liquid outlet port allowing the liquid stored in the second storage chamber to be discharged therefrom; and a second air communication portion configured to allow the second storage chamber to communicate with the atmosphere. The connecting portion includes a first liquid channel allowing the liquid to circulate between the liquid supply port and the liquid inlet port. The recording head is in communication with the liquid outlet port through a second liquid channel. The recording head includes a nozzle configured to eject the liquid supplied from the liquid outlet port through the second liquid channel. The detector is configured to detect whether or not a level of the liquid stored in the second storage chamber comes to a prescribed position. The first storage chamber is defined by inner surfaces including an inner partitioning surface positioned close to the tank. The first storage chamber is partitioned by a wall portion into an upper space above the wall portion and a lower space below the wall portion. The wall portion extends from the inner partitioning surface in a first direction away from the tank. The wall portion is formed with a communication opening through which the upper space and the lower space communicate with each other. The liquid supply port is in communication with the lower space of the first storage chamber. The prescribed position of the liquid to be detected by the detector is positioned higher than the communication opening in a vertical direction. In this image-recording apparatus, a following inequality (3) is satisfied: $Pm<\rho \cdot Hc \cdot g - Ic \cdot Rn$, in which: Pm is a withstand pressure of meniscus of the liquid formed at the communication opening; P is density of the liquid; Hc is a length in the vertical direction between the liquid supply port and the communication opening; g is gravitational acceleration; Ic is a flow rate of the liquid flowing from the first storage chamber to the second storage chamber when a level of the liquid in the first storage chamber is at the communication opening and the level of the liquid in the second storage chamber is at the prescribed position; and Rn is a passage resistance at the first liquid channel.

DETAILED DESCRIPTION

Figure 1A:
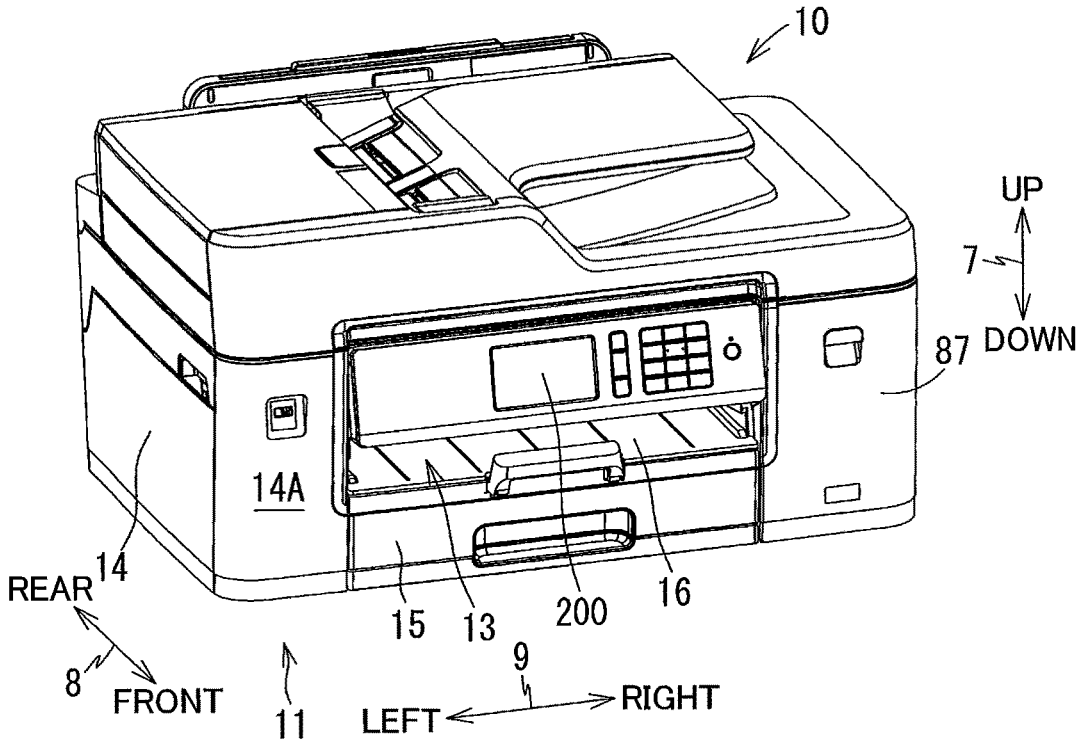
FIG. 1A is a perspective view of a multifunction peripheral according to an embodiment, illustrating a closed position of a cover of the multifunction peripheral.

A multifunction peripheral 10 as an example of an image-recording apparatus according to one embodiment will be described with reference to the accompanying drawings, wherein like parts and components are designated by the same reference numerals to avoid duplicating description.

In the following description, up, down, front, rear, left, and right directions related to the multifunction peripheral 10 will be referred to assuming that the multifunction peripheral 10 is disposed on a horizontal plane so as to be operable, as shown in FIG. 1A. Note that this posture of the multifunction peripheral 10 illustrated in FIG. 1A will also be referred to as an "operable posture". Specifically, an up-down direction 7 of the multifunction peripheral 10 is defined based on the operable posture of the multifunction peripheral 10. A front-rear direction 8 is defined assuming that a surface of the multifunction peripheral 10 formed with an opening 13 is a front surface 14A of the multifunction peripheral 10 in the operable posture. A left-right direction 9 is defined based on an assumption that the multifunction peripheral 10 in the operable posture is viewed from its front surface. In the present embodiment, in the operable posture of the multifunction peripheral 10, the up-down direction 7 is parallel to a vertical direction, and the front-rear direction 8 and the left-right direction 9 are parallel to a horizontal direction. Further, the front-rear direction 8 is perpendicular to the left-right direction 9.

[Overall Structure of Multifunction Peripheral 10]

Figure 1B:
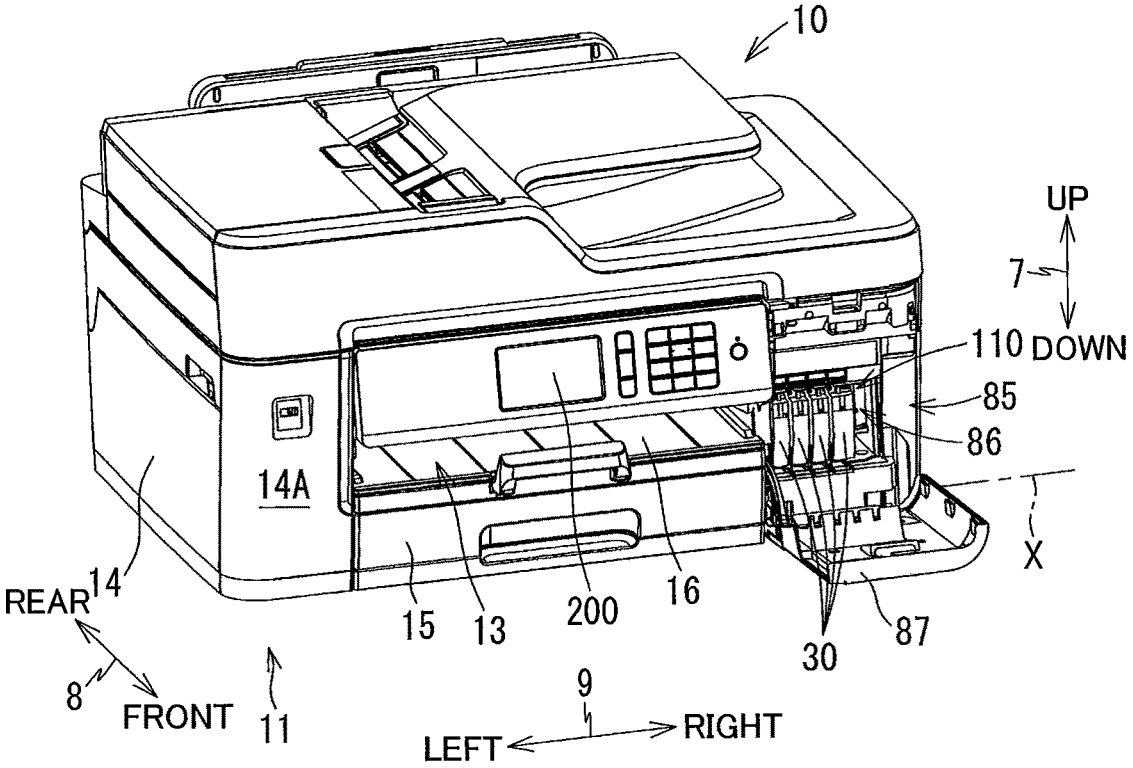
FIG. 1B is a perspective view of the multifunction peripheral according to the embodiment, illustrating an open position of the cover.

As illustrated in FIGS. 1A and 1B, the multifunction peripheral 10 has a substantially rectangular parallelepiped shape. The multifunction peripheral 10 has a lower portion in which a printer portion 11 is provided. The printer portion 11 is configured to record an image on a sheet of paper 12 (see FIG. 2) based on an inkjet recording method. The printer portion 11 includes a casing 14 whose front surface 14A is formed with the opening 13. On the front surface 14A, a display 200 is also provided to display various information thereon.

Figure 2:
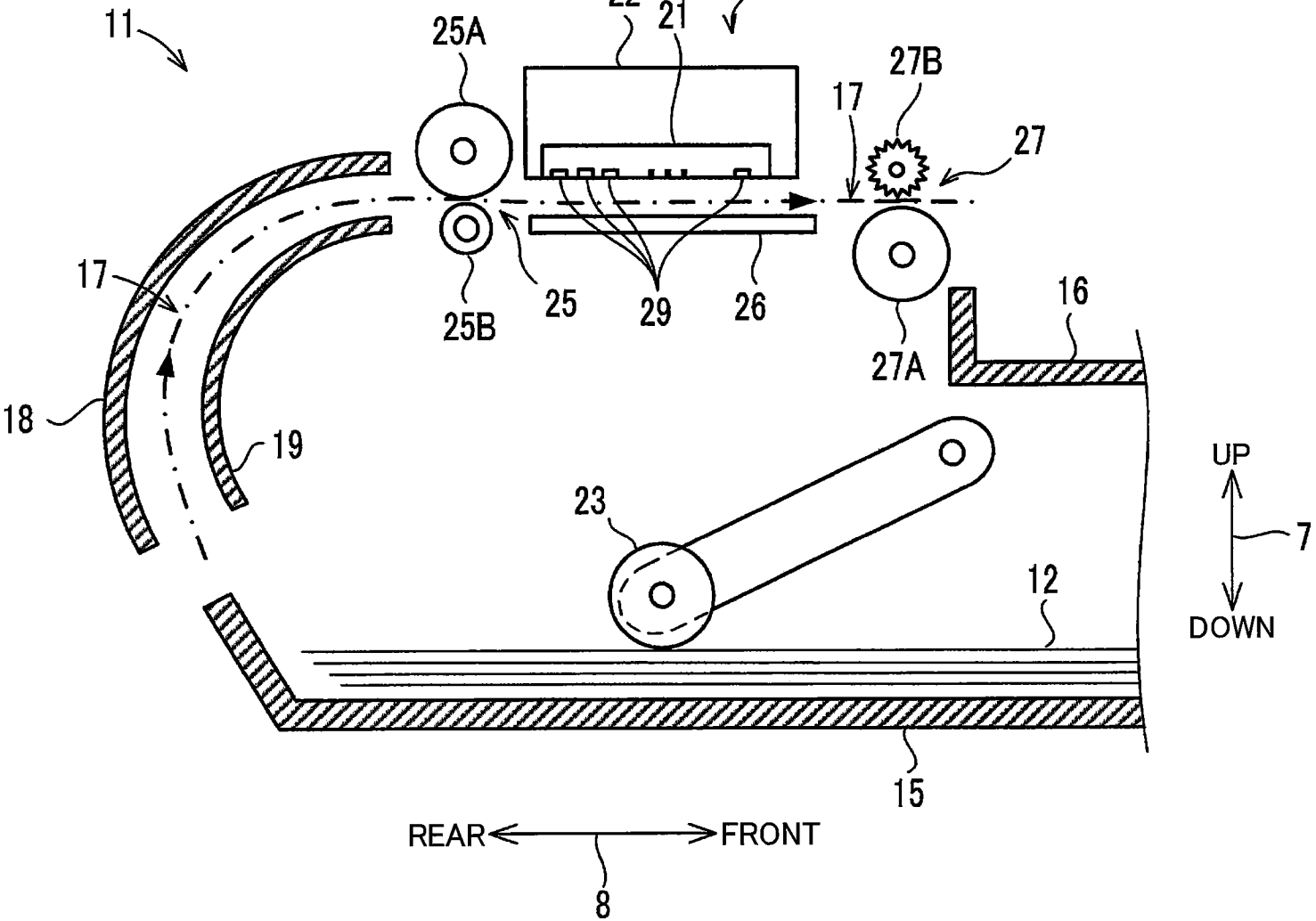
FIG. 2 is a vertical cross-sectional view schematically illustrating an internal configuration of a printer portion of the multifunction peripheral according to the embodiment.

As illustrated in FIG. 2, within the casing 14, a feeding roller 23, a feeding tray 15, a discharge tray 16, a pair of conveying rollers 25, a recording portion 24, a pair of discharging rollers 27, a platen 26, and a cartridge-attachment portion 110 (see FIG. 1B) are disposed. The multifunction peripheral 10 has various functions such as a facsimile function and a printing function.

<Feeding Tray 15, Discharge Tray 16, and Feeding Roller 23>

As illustrated in FIGS. 1A and 1B, the feeding tray 15 is configured to be inserted into and extracted from the casing 14 through the opening 13 in the front-rear direction 8 by a user. The opening 13 is positioned at a center portion of the front surface 14A of the casing 14 in the left-right direction 9. As illustrated in FIG. 2, the feeding tray 15 is configured to support the sheets 12 in a stacked state.

The discharge tray 16 is disposed above the feeding tray 15. The discharge tray 16 is configured to support the sheets 12 discharged by the discharging rollers 27.

The feeding roller 23 is configured to feed each of the sheets 12 supported in the feeding tray 15 onto a conveying path 17. The feeding roller 23 is configured to be driven by a feeding motor 172 (see FIG. 8).

<Conveying Path 17>

As illustrated in FIG. 2, the conveying path 17 is a space partially defined by an outer guide member 18 and an inner guide member 19 opposing each other at a predetermined interval inside the printer portion 11. The conveying path 17 extends rearward from a rear end portion of the feeding tray 15, and then, makes a U-turn frontward while extending upward at a rear portion of the printer portion 11, passes through a space between the recording portion 24 and the platen 26, and reaches the discharge tray 16. A portion of the conveying path 17 positioned between the conveying rollers 25 and the discharging rollers 27 is provided substantially at a center portion of the multifunction peripheral 10 in the left-right direction 9, and extends in the front-rear direction 8. A conveying direction of each sheet 12 in the conveying path 17 is indicated by a dashed-dotted arrow in FIG. 2.

<Conveying Rollers 25>

As illustrated in FIG. 2, the pair of conveying rollers 25 is disposed at the conveying path 17. The conveying rollers 25 include a conveying roller 25A and a pinch roller 25B arranged to oppose each other. The conveying roller 25A is configured to be driven by a conveying motor 171 (see FIG. 8). The pinch roller 25B is configured to be rotated following rotation of the conveying roller 25A. As the conveying roller 25A makes forward rotation in response to forward rotation of the conveying motor 171, each of the sheets 12 is nipped between the conveying roller 25A and the pinch roller 25B to be conveyed in the conveying direction (i.e., frontward direction).

<Discharging Rollers 27>

As illustrated in FIG. 2, the pair of discharging rollers 27 is disposed downstream relative to the pair of conveying rollers 25 in the conveying direction at the conveying path 17. The discharging rollers 27 include a discharging roller 27A and a spur 27B arranged to oppose each other. The discharging roller 27A is configured to be driven by the conveying motor 171 (see FIG. 8). The spur 27B is configured to be rotated following rotation of the discharging roller 27A. As the discharging roller 27A makes forward rotation in response to the forward rotation of the conveying motor 171, each sheet 12 is nipped between the discharging roller 27A and the spur 27B and is conveyed in the conveying direction (i.e., frontward direction).

<Recording Portion 24>

As illustrated in FIG. 2, the recording portion 24 is disposed a position between the conveying roller pair 25 and the discharging roller pair 27 at the conveying path 17. The recording portion 24 is arranged to oppose the platen 26 in the up-down direction 7, with the conveying path 17 interposed between the recording portion 24 and the platen 26. The recording portion 24 is positioned above the conveying path 17, while the platen 26 is positioned below the conveying path 17. The recording portion 24 includes a carriage 22 and a recording head 21.

Figure 3:
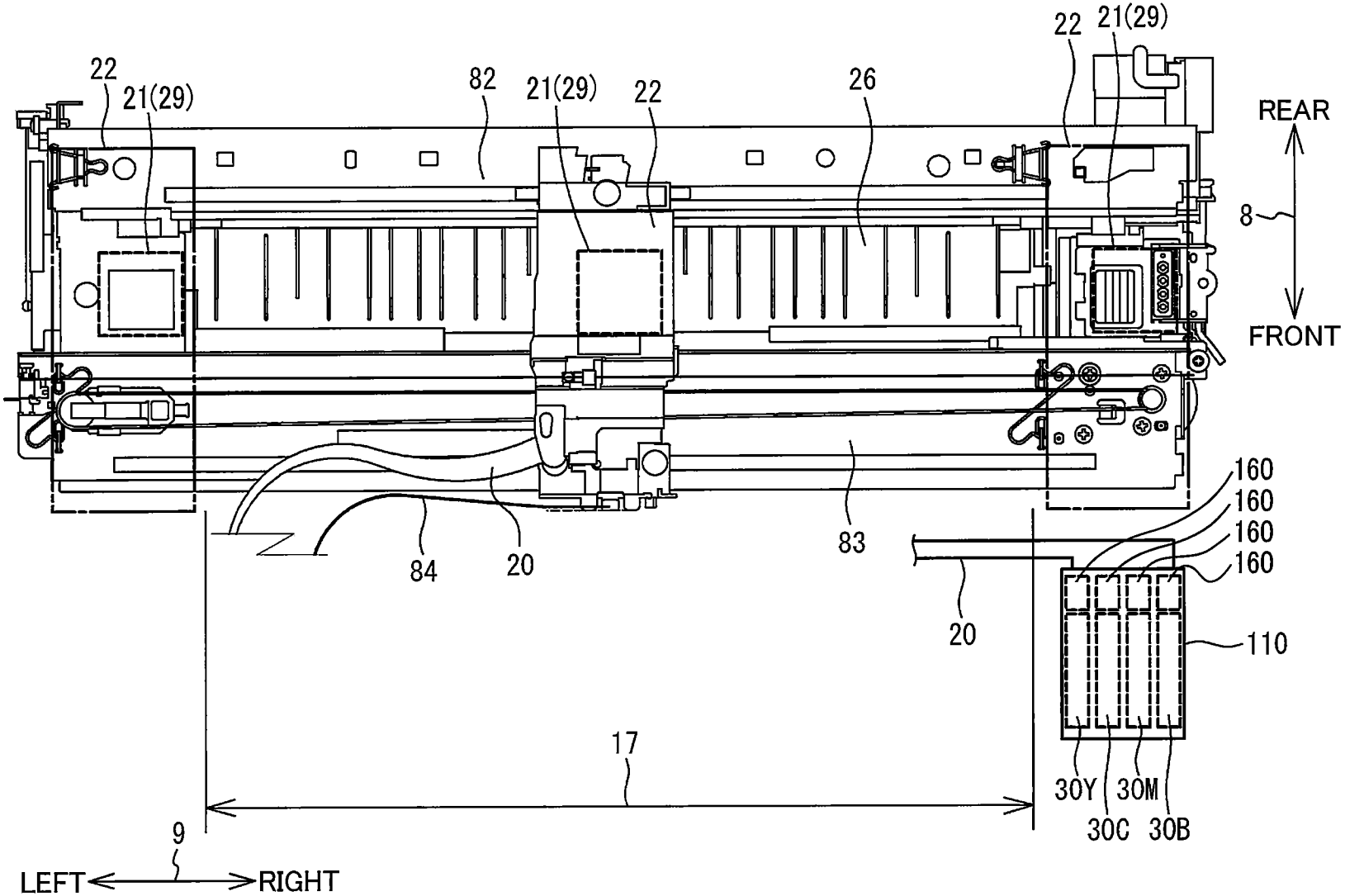
FIG. 3 is a plan view illustrating arrangement of a carriage and a platen relative to a cartridge-attachment portion of the multifunction peripheral according to the embodiment.

As illustrated in FIG. 3, the carriage 22 is supported by guide rails 82 and 83. The guide rails 82 and 83 extend in the left-right direction 9 and are spaced apart from each other in the front-rear direction 8. The guide rails 82 and 83 are supported by a frame (not shown) of the printer portion 11. The carriage 22 is connected to a well-known belt mechanism provided at the guide rail 83. The belt mechanism is driven by a carriage-driving motor 173 (see FIG. 8). The carriage 22 connected to the belt mechanism is configured to make reciprocating movements in the left-right direction 9 in response to receiving driving force of the carriage-driving motor 173. The carriage 22 is configured to move within a range from a right side relative to a right end of the conveyance path 17 to a left side relative to a left end of the conveyance path 17, as indicated by alternate long and short dash lines in FIG. 3.

As illustrated in FIG. 3, a bundle of ink tubes 20 and a flexible flat cable 84 extend from the carriage 22.

The ink tubes 20 connect the cartridge-attachment portion 110 to the recording head 21. Each of the ink tubes 20 is configured to supply ink stored in a corresponding ink cartridge 30 attached to the cartridge-attachment portion 110 to the recording head 21. In the present embodiment, four ink cartridges 30 are configured to be attached to the cartridge-attachment portion 110. Specifically, the four ink cartridges 30 include: an ink cartridge 30B storing black ink, an ink cartridge 30M storing ink of a magenta color, an ink cartridge 30C storing ink of a cyan color, and an ink cartridge 30Y storing ink of a yellow color. These four ink cartridges 30B, 30M, 30C and 30M will be collectively referred to as "ink cartridges 30", hereinafter. Four ink tubes 20 are provided in one-to-one correspondence with the respective ink cartridges 30B, 30M, 30C and 30M so that ink of respective four colors (black, magenta, cyan, and yellow) can flow through the corresponding internal spaces of the ink tubes 20. These four ink tubes 20 are bundled and connected to the recording head 21 mounted on the carriage 22.

The flexible flat cable 84 is configured to establish electrical connection between a controller 130 (see FIG. 8) and the recording head 21. The flexible flat cable 84 is configured to transmit control signals outputted from the controller 130 to the recording head 21.

As illustrated in FIG. 2, the recording head 21 is mounted on the carriage 22. The recording head 21 includes a plurality of nozzles 29 and a plurality of piezoelectric elements 56 (see FIG. 8). The nozzles 29 are arranged at a lower surface of the recording head 21. Ink flow passages are formed in the recording head 21. The piezoelectric elements 56 are configured to deform a portion of the ink flow passages to allow ink droplets to be ejected through the nozzles 29. As will be described later in detail, the piezoelectric elements 56 are configured to operate upon receipt of electric power supplied by the controller 130.

The recording portion 24 is configured to be controlled by the controller 130. As the carriage 22 moves in the left-right direction 9, the recording head 21 ejects ink droplets, through the nozzles 29, toward the conveying path 17, i.e., onto the sheet 12 supported by the platen 26.

In this way, an image is recorded on each sheet 12 supported by the platen 26, and the ink stored in each of the ink cartridges 30 is consumed.

<Platen 26>

As illustrated in FIG. 2, the platen 26 is disposed between the conveying rollers 25 and the discharging rollers 27 at the conveying path 17. The platen 26 is arranged to oppose the recording portion 24 in the up-down direction 7, with the conveying path 17 interposed between the platen 26 and the recording portion 24. The platen 26 supports the sheet 12 conveyed by the conveying rollers 25 from below.

<Cover 87>

As illustrated in FIG. 1B, an opening 85 is formed in the front surface 14A of the casing 14 at a right end portion thereof. Rearward of the opening 85, an accommodation space 86 is formed to accommodate the cartridge-attachment portion 110 therein. A cover 87 is assembled to the casing 14 so as to be capable of covering the opening 85. The cover 87 is pivotally movable, about a pivot axis X (pivot center) extending in the left-right direction 9, between a closed position (a position illustrated in FIG. 1A) for closing the opening 85 and an open position (a position illustrated in FIG. 1B) for exposing the opening 85.

<Cartridge-Attachment Portion 110>

As illustrated in FIG. 1B, the cartridge-attachment portion 110 is positioned in a right-front portion on the casing 14. More specifically, as illustrated in FIG. 3, the cartridge-attachment portion 110 is disposed at a position frontward relative to the recording head 21 and rightward relative to the conveying path 17.

Figure 4:
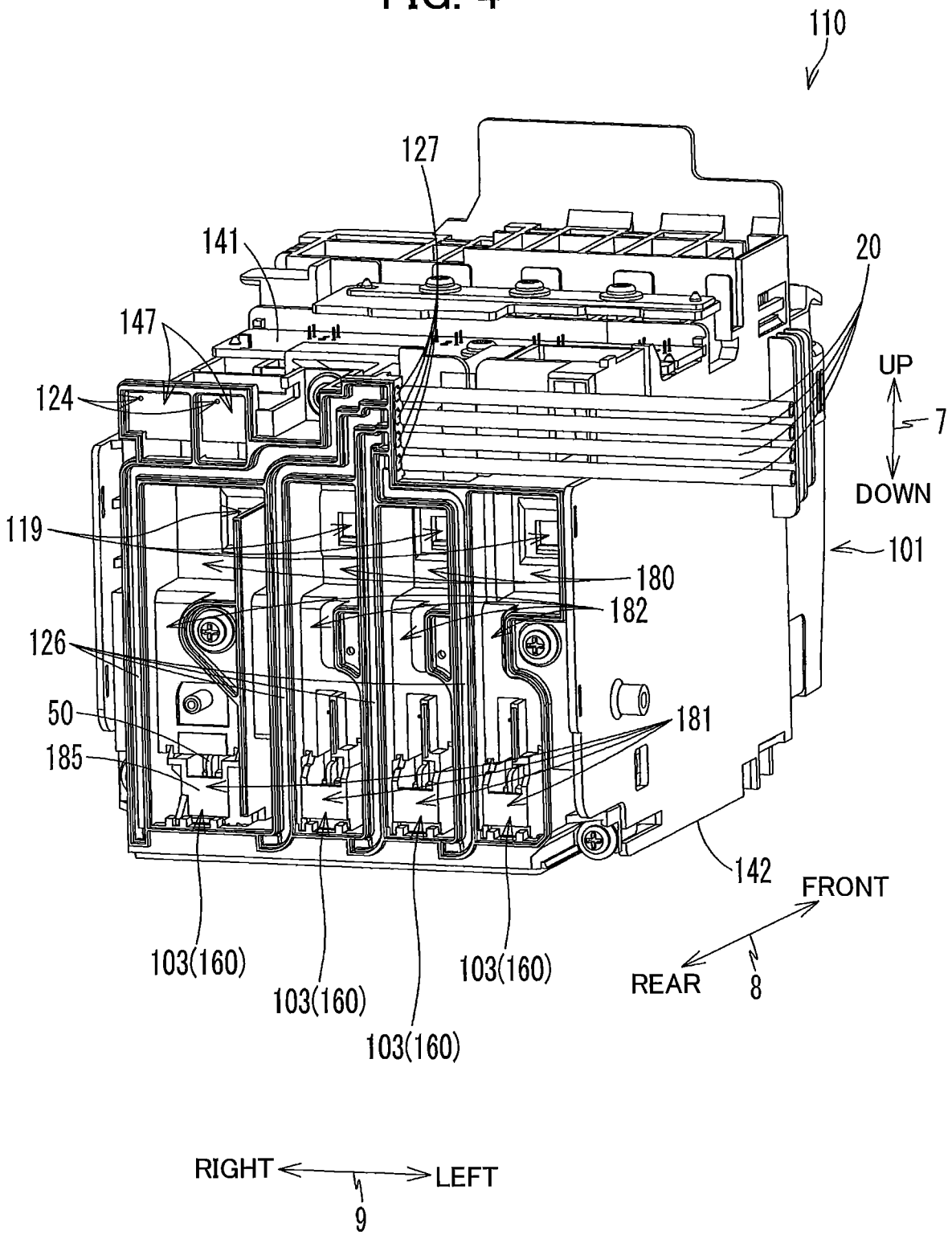
FIG. 4 is a perspective view illustrating the external appearance of the cartridge-attachment portion according to the embodiment as viewed from a rear side thereof.
Figure 5:
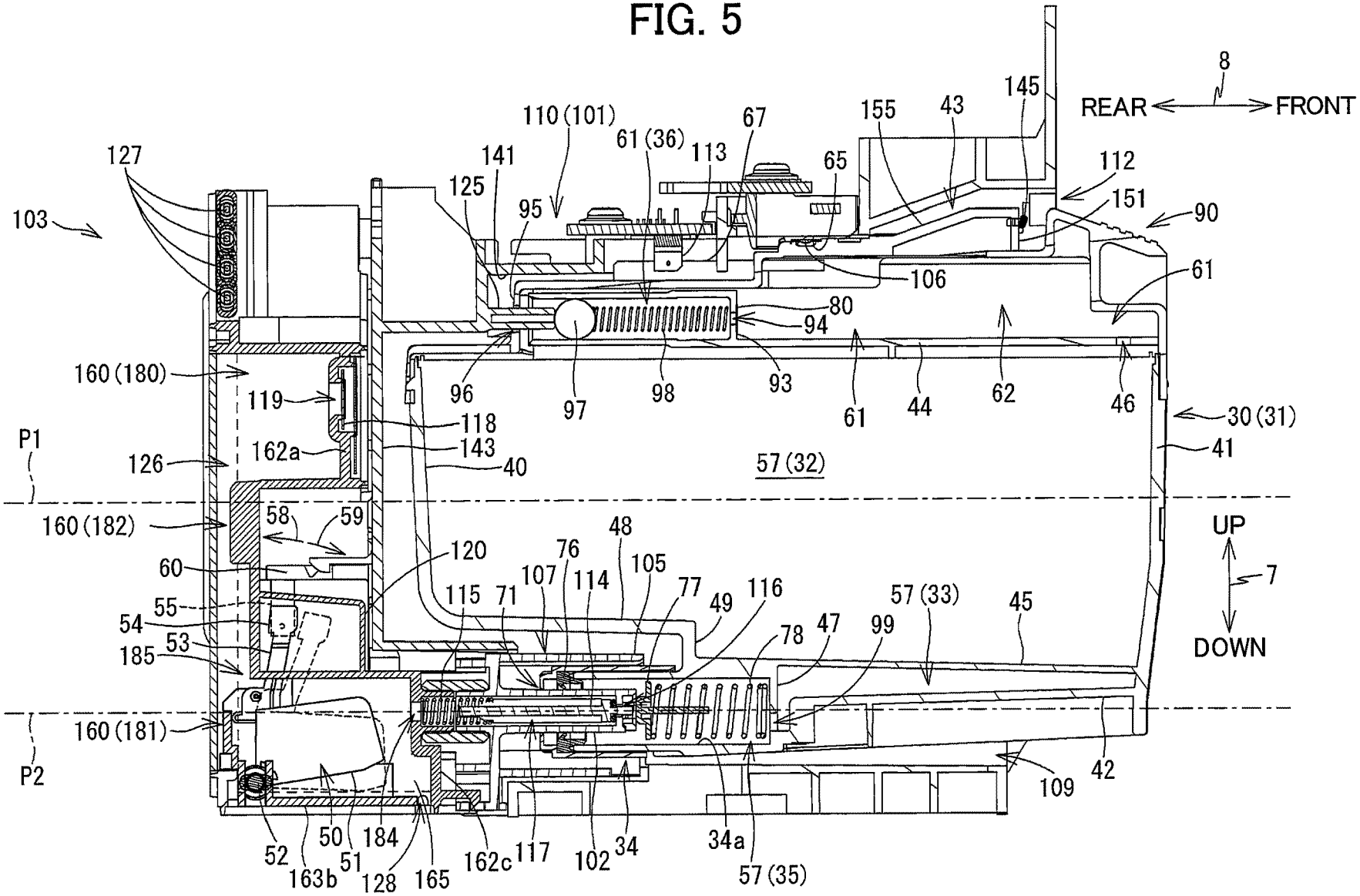
FIG. 5 is a vertical cross-sectional view illustrating a state where an ink cartridge is attached to the cartridge-attachment portion.

As illustrated in FIGS. 4 and 5, the cartridge-attachment portion 110 includes a case 101, contacts 106, rods 125, attachment sensors 113, a lock shaft 145, tanks 103, and liquid-level sensors 55.

The four ink cartridges 30 corresponding to the four colors of ink (cyan, magenta, yellow, and black) are attachable to and detachable from the cartridge-attachment portion 110. Specifically, the respective ink cartridges 30 can be attached to the case 101 by being moved rearward, and detached from the case 101 by being moved frontward. One set of four contacts 106, one rod 125, one attachment sensor 113, one tank 103, and one liquid-level sensor 55 are provided for each of the four ink cartridges 30. Thus, in the present embodiment, four sets of the four contacts 106, four rods 125, four attachment sensors 113, four tanks 103, and four liquid-level sensors 55 are provided at the cartridge-attachment portion 110. Note that the number of the ink cartridges 30 that can be accommodated in the cartridge-attachment portion 110 is not limited to four, but may be any number.

The four sets of the contacts 106 have the same configurations as one another. The four rods 125 have the same configurations as one another. Likewise, the four attachment sensors 113 have the same configurations as one another. And the four liquid-level sensors 55 have the same configurations as one another. Accordingly, hereinafter, descriptions will be made only about one of the four sets of contacts 106, one of the four rods 125, one of the four attachment sensors 113 and one of the four liquid-level sensors 55, while descriptions for the remaining three of these components will be omitted for simplifying description.

Also note that each of the four tanks 103 is configured to store one of four colors of ink among black, cyan, magenta and yellow. Hereinafter, the four tanks 103 will be collectively referred to as "tanks 103", wherever appropriate.

<Case 101>

As illustrated in FIG. 5, the case 101 has a box-like shape defining an internal space therein. The case 101 has a depth in the front-rear direction 8, a width in the left-right direction 9 and a height in the up-down direction 7. The case 101 has a rear end portion including an end wall 143, and a front end portion formed with an opening 112. The opening 112 opposes the end wall 143 in the front-rear direction 8. The internal space of the case 101 is exposed to the outside through the opening 112. The opening 112 can be exposed to the outside of the multifunction peripheral 10 through the opening 85 of the casing 14 when the cover 87 is at the open position shown in FIG. 1B.

The ink cartridges 30 can be inserted into and extracted from the case 101 through the opening 85 of the casing 14 and the opening 112 of the cartridge-attachment portion 110. In the case 101, a bottom wall 142 is formed with four guide grooves 109 (see FIG. 5) for guiding insertion and extraction of the respective ink cartridges 30 in the front-rear direction 8. Insertion and removal of the ink cartridges 30 in the front-rear direction 8 are guided by the corresponding guide grooves 109 while lower end portions of the ink cartridges 30 are inserted in the corresponding guide grooves 109.

<Contacts 106>

As illustrated in FIG. 5, each set of the four contacts 106 is provided on a lower surface of a ceiling wall 141 of the case 101. The four contacts 106 in each set protrudes downward toward the internal space of the case 101 from the lower surface of the ceiling wall 141. Although not illustrated in detail in the drawings, in each set, the four contacts 106 are arranged spaced apart from one another in the left-right direction 9. Each set of the four contacts 106 is provided for each one of the four ink cartridges 30 that can be accommodated in the case 101. The four contacts 106 in each set is arranged each at a position corresponding to one of four electrodes 65 (described later) of the ink cartridge 30. Each contact 106 is made of a material having electrical conductivity and resiliency. The contacts 106 are therefore upwardly resiliently deformable. Note that the number of the contacts 106 and the number of electrodes 65 may be arbitrary.

Each contact 106 is electrically connected to the controller 130 (see FIG. 8) via an electrical circuit. When the contacts 106 are respectively engaged with the corresponding electrodes 65 and electrically connected thereto, a certain voltage is applied to at least one of the electrodes 65, one of the electrodes 65 is grounded, and electric power is supplied to another one of the electrodes 65, for example. Due to establishment of the electrical connection between the contacts 106 and the corresponding electrodes 65, the controller 130 is allowed to access data stored in an IC (not illustrated) of the corresponding ink cartridge 30. Outputs from the electrical circuit are configured to be inputted into the controller 130.

<Rod 125>

As illustrated in FIG. 5, each rod 125 is provided at the end wall 143 and above a corresponding ink needle 102 (described later). The rod 125 protrudes frontward from the end wall 143 of the case 101. The rod 125 has a cylindrical shape. The rod 125 is inserted in an air communication port 96 (described later) in a state where the corresponding ink cartridge 30 is attached to the cartridge-attachment portion 110, that is, in a state where the ink cartridge 30 is at an attached position.

<Attachment Sensor 113>

As illustrated in FIG. 5, each attachment sensor 113 is also disposed at the lower surface of the ceiling wall 141 of the case 101. The attachment sensor 113 is configured to detect whether or not the ink cartridge 30 is attached to the cartridge-attachment portion 110. The attachment sensor 113 is disposed at a position frontward of the rod 125 but rearward of the contacts 106.

In the present embodiment, the attachment sensor 113 includes a light-emitting portion and a light-receiving portion. The light-emitting portion is positioned rightward or leftward relative to the light-receiving portion so as to be spaced apart therefrom in the left-right direction 9. When the ink cartridge 30 has been attached to the cartridge-attachment portion 110, a light-blocking plate 67 (see FIG. 6, described later) of the attached ink cartridge 30 is disposed between the light-emitting portion and the light-receiving portion of the attachment sensor 113. In other words, the light-emitting portion and the light-receiving portion are arranged to oppose each other, with the light-blocking plate 67 of the attached ink cartridge 30 interposed between the light-emitting portion and the light-receiving portion.

The attachment sensor 113 is configured to output different detection signals depending on whether or not light emitted from the light-emitting portion in the left-right direction 9 is received by the light-receiving portion. For example, the attachment sensor 113 is configured to output a low-level signal to the controller 130 (see FIG. 8) in a case where the light-receiving portion does not receive the light emitted from the light-emitting portion (that is, when an intensity of the light received at the light-receiving portion is less than a predetermined intensity). On the other hand, the attachment sensor 113 is configured to output a high-level signal to the controller 130 (see FIG. 8) in a case where the light emitted from the light-emitting portion is received by the light-receiving portion (that is, when the intensity of the received light is equal to or greater than the predetermined intensity).

<Lock Shaft 145>

As illustrated in FIG. 5, the lock shaft 145 extends in the left-right direction 9 in the vicinity of the ceiling wall 141 of the case 101 and in the vicinity of the opening 112. The lock shaft 145 is a bar-like member extending in the left-right direction 9. The lock shaft 145 is, for example, a metal column. The lock shaft 145 both ends in the left-right direction 9 fixed to side walls defining left and right ends of the case 101. The lock shaft 145 extends in the left-right direction 9 across four spaces defined in the case 101 for accommodating the respective four ink cartridges 30.

The lock shaft 145 functions to hold each of the ink cartridges 30 attached to the cartridge-attachment portion 110 at the attached position. The ink cartridges 30 are respectively engaged with the lock shaft 145 in a state where the ink cartridges 30 are attached to the cartridge-attachment portion 110. The lock shaft 145 can retain each ink cartridge 30 in the cartridge-attachment portion 110 against urging forces of coil springs 78 and 98 (described later) of the ink cartridge 30 that push the ink cartridge 30 frontward.

<Tanks 103>

Referring to FIG. 4, the case 101 includes four tanks 103 arranged to be aligned with one another in the left-right direction 9. The four tanks 103 correspond to the four ink cartridges 30 of respective colors. That is, ink stored in each ink cartridge 30 is configured to flow into the corresponding one of the tanks 103. In FIG. 5, only one of the four tanks 103 is depicted for simplifying description.

The tanks 103 are positioned rearward relative to the end wall 143 of the case 101. Each tank 103 has a generally box shape. Each tank 103 includes a box-shaped tank main body and a connecting portion 107. In the tank main body, a storage chamber 160 is defined.

The connecting portion 107 is adapted to be connected to an ink supply portion 34 of the corresponding ink cartridge 30 attached to the cartridge-attachment portion 110. Upon connection to the ink supply portion 34, the connecting portion 107 is allowed to communicate with a storage chamber 57 storing ink in the ink cartridge 30. The ink stored in the ink cartridge 30 is thus allowed to flow into the corresponding storage chamber 160 through the corresponding connecting portion 107. That is, each storage chamber 160 is configured to accommodate ink supplied from the corresponding ink supply portion 34 connected to the corresponding connecting portion 107.

<Connecting Portion 107>

As illustrated in FIG. 5, each connecting portion 107 includes the ink needle 102 having a hollow configuration, and a guide portion 105.

The ink needle 102 is made of resin and has a generally tubular shape. The ink needle 102 is disposed at a lower end portion of the end wall 143 of the case 101. Specifically, the ink needle 102 is disposed at the end wall 143 of the case 101 at a position corresponding to the ink supply portion 34 of the corresponding ink cartridge 30 attached to the cartridge-attachment portion 110. The ink needle 102 protrudes frontward from the end wall 143 of the case 101.

The guide portion 105 has a cylindrical shape, and is disposed at the end wall 143 to surround the ink needle 102. The guide portion 105 protrudes frontward from the end wall 143 of the case 101. A protruding end (front end) of the guide portion 105 is open. Specifically, the ink needle 102 is positioned at a diametrical center of the guide portion 105. The guide portion 105 is so shaped that the corresponding ink supply portion 34 of the attached ink cartridge 30 is received in the guide portion 105.

The connecting portion 107 is not connected to the ink supply portion 34 of the ink cartridge 30 in a state where the ink cartridge 30 is not attached to the cartridge-attachment portion 110. During an insertion process of the ink cartridge 30 into the cartridge-attachment portion 110, i.e., in the course of action for bringing the ink cartridge 30 into an attached position in the cartridge-attachment portion 110 (i.e., a position illustrated in FIG. 5), the ink supply portion 34 of the corresponding ink cartridge 30 enters into the guide portion 105. As the ink cartridge 30 is further inserted rearward into the cartridge-attachment portion 110, the ink needle 102 enters into an ink supply port 71 formed in the ink supply portion 34. As a result, the connecting portion 107 is connected to the ink supply portion 34. Hence, ink stored in a storage chamber 33 formed in the ink cartridge 30 is allowed to flow into the corresponding tank 103 through an ink valve chamber 35 formed in the ink supply portion 34 and an internal space 117 defined in the ink needle 102.

Incidentally, the ink needle 102 may have a flat-shaped tip end or a pointed tip end.

As illustrated in FIG. 5, a valve 114 and a coil spring 115 are accommodated in the internal space 117 of the ink needle 102. The valve 114 is movable in the front-rear direction 8 to open and close an opening 116 formed in a protruding tip end portion of the ink needle 102. That is, the valve 114 is configured to open and close the internal space 117 of the ink needle 102. The coil spring 115 urges the valve 114 frontward. Accordingly, the valve 114 closes off the opening 116 in a state where no external force is applied to the valve 114 (i.e., in a state where the ink cartridge 30 is not attached to the cartridge-attachment portion 110). Further, a front end portion of the valve 114 urged by the coil spring 115 protrudes frontward relative to the opening 116 in a state where no external force is applied to the valve 114. The valve 114 opens the opening 116 in the process of connecting the connecting portion 107 to the ink supply portion 34.

<Overall Structure of the Storage Chambers 160>

Each of the tanks 103 includes the storage chamber 160. Referring to FIG. 3, the storage chambers 160 corresponding to the respective ink cartridges 30B, 30M, 30C, and 30Y are positioned frontward relative to the nozzles 29 of the recording head 21 in the front-rear direction 8. The storage chambers 160 are positioned rightward relative to the conveying path 17 in the left-right direction 9.

As illustrated in FIG. 5, each storage chamber 160 includes a buffer chamber 180, a first chamber 181 and a second chamber 182.

The buffer chamber 180 is positioned above the second chamber 182. The first chamber 181 is positioned below the second chamber 182. An upper end of the second chamber 182 is in communication with the buffer chamber 180. A lower end of the second chamber 182 is in communication with the first chamber 181. That is, the buffer chamber 180 and first chamber 181 are in communication with each other through the second chamber 182.

The upper end of the second chamber 182 is in communication with a right end portion of the buffer chamber 180. The lower end of the second chamber 182 is in communication with a right end portion of the first chamber 181. Further, the upper end of the second chamber 182 is in communication with a rear end portion of the buffer chamber 180. The lower end of the second chamber 182 is in communication with a rear end portion of the first chamber 181.

A projecting portion 120 is provided above the first chamber 181 and frontward of the second chamber 182. The projecting portion 120 also includes side walls facing rightward and leftward and made of a material capable of transmitting light. The projecting portion 120 defines therein an internal space that is in communication with the first chamber 181 and second chamber 182. That is, the internal space of the projecting portion 120 constitutes a portion of the storage chamber 160. Within this internal space of the projecting portion 120, an arm 53 and a detected portion 54 of a pivoting member 50 (described later) are disposed. Note that the projecting portion 120 may communicate with one of the first chamber 181 and second chamber 182, rather than both of the first chamber 181 and second chamber 182.

A front wall 162*c* defines a front end of the first chamber 181. A communication port 184 is formed in the front wall 162*c*. The first chamber 181 is in communication with the internal space 117 of the ink needle 102 via the communication port 184. This structure allows the ink flowing out of the ink cartridge 30 through the ink needle 102 to flow into the storage chamber 160 and to be stored therein.

In a state where a liquid level of the ink stored in the storage chamber 160 is at the same height as the communication port 184 in the up-down direction 7, the buffer chamber 180 and second chamber 182 are positioned higher than the liquid level of the ink stored in the storage chamber 160. In the present embodiment, "the liquid level of the ink stored in the storage chamber 160 is at the same height as the communication port 184" denotes a state where the liquid level is positioned at the same height as an axial center of the ink needle 102 (i.e., a center of the communication port 184) in the up-down direction 7, i.e., at the same height as a center of the ink supply port 71 in the up-down direction 7. More specifically, in the present embodiment, the liquid level is deemed to be "at the same height as the communication port 184" when the liquid level is at a position P2 indicated by a broken line in FIG. 5.

Incidentally, in a state where the liquid level of the ink stored in the storage chamber 160 is at the same height as an upper edge of the communication port 184 in the up-down direction 7, the buffer chamber 180 is positioned higher than the liquid level.

The storage chamber 160 is in communication with a corresponding ink passage 126 via a communication port 128. In the present embodiment, the first chamber 181 of the storage chamber 160 is in communication with the ink passage 126 through the communication port 128. The communication port 128 is formed in a lower end portion of a side wall 165 defining a lateral end of the first chamber 181 in the left-right direction 9.

The communication port 128 is positioned lower than the communication port 184 in the up-down direction 7.

The ink passage 126 is a space enclosed by the side wall 165 of the first chamber 181 of the corresponding storage chamber 160. In FIG. 5, the ink passage 126 is depicted by a broken line. The ink passage 126 extends from the communication port 128 rearward and then upward to be connected to a corresponding ink outlet port 127 (also see FIG. 4). The ink outlet port 127 is connected to corresponding one of the ink tubes 20. With this structure, the ink stored in the storage chamber 160 is allowed to flow out of the storage chamber 160 into the ink passage 126 through the communication port 128, and is supplied to the recording head 21 through the corresponding ink passage 126 and ink tube 20.

The buffer chamber 180 is in communication with a corresponding air communication port 124 that is open to the atmosphere (see FIG. 4). The air communication port 124 is disposed at the tank 103. The buffer chamber 180 is in communication with the corresponding air communication port 124 through a through-hole 119 formed in a front wall 162*a* of the buffer chamber 180 (see FIG. 5) and an air flow path 147 (see FIG. 4) connecting the through-hole 119 to the corresponding air communication port 124. The through-hole 119 is sealed with a semipermeable membrane 118. The semipermeable membrane 118 allows passage of air therethrough, but blocks circulation of ink through the semipermeable membrane 118. That is, the storage chamber 160 is allowed to communicate with the atmosphere via the air flow path 147 connecting the through-hole 119 to the corresponding air communication port 124. The semi-permeable membrane 118 is provided at the air flow path 147.

In a state where a predetermined maximum amount of ink is stored in the storage chamber 160, the ink provides a liquid level of P1 in the up-down direction 7 (see FIG. 5). In the present embodiment, this position P1 corresponding to the liquid level of the ink of the predetermined maximum amount is located in the second chamber 182. However, the position P1 may be located outside the second chamber 182. For example, the position P1 may be located in the buffer chamber 180.

In the state where the predetermined maximum amount of ink is stored in the storage chamber 160, the internal space within the storage chamber 160 can be divided into two compartments: a liquid-storage space and an air communication space. The liquid-storage space is a portion positioned below the position P1 in the storage chamber 160. The air communication space is a portion above the position P1 in the storage chamber 160.

<Pivoting Member 50>

As illustrated in FIG. 5, the pivoting member 50 is disposed in the storage chamber 160 of each tank 103. The pivoting member 50 is supported by a support member 185 provided in each storage chamber 160 so as to be pivotally movable in directions of arrows 58 and 59.

The pivoting member 50 may be supported by a structure other than the support member 185. For example, the pivoting member 50 may be supported by a wall of the case 101 defining the storage chamber 160. In this case, the support member 185 may not be disposed within the storage chamber 160.

The pivoting member 50 includes a float 51, a shaft 52, the arm 53, and the detected portion 54. The float 51 constitutes a lower portion of the pivoting member 50. The float 51 is made of a material whose specific gravity is smaller than a specific gravity of the ink stored in the storage chamber 160. The shaft 52 protrudes from left and right surfaces of the float 51 in the left-right direction 9. The shaft 52 is rotatably supported by the support member 185 so that the pivoting member 50 is pivotally movable about an axis of the shaft 52. The shaft 52 is positioned downward relative to the corresponding communication port 184. The float 51 and shaft 52 are located within the first chamber 181 of each storage chamber 160.

The arm 53 protrudes substantially upward from the float 51. The detected portion 54 is provided at a protruding tip end portion of the arm 53. That is, the detected portion 54 constitutes a pivoting end portion of the pivoting member 50. A portion of the arm 53 and the detected portion 54 are located in the internal space of the projecting portion 120.

The detected portion 54 is positioned upward relative to the communication port 184. The detected portion 54 has a plate shape extending in the up-down direction 7 and the front-rear direction 8. The detected portion 54 is made of a material that can block light emitted from a light-emitting portion of the corresponding liquid-level sensor 55 (described later).

In a state where the liquid level of the ink stored in the storage chamber 160 is higher than the position P2 (more specifically, the center of the communication port 184) in the up-down direction 7, in other words, in a state where the liquid level of the ink stored in the storage chamber 57 of the ink cartridge 30 is higher than the position P2 of the ink supply portion 34 (more specifically, the center of the ink supply port 71) in the up-down direction 7, the pivoting member 50 pivotally moves in the direction of the arrow 58 due to buoyancy acting on the float 51. As a result, the pivoting member 50 is positioned at a detection position indicated by a solid line in FIG. 5.

As the ink stored in the storage chamber 160 and in the ink valve chamber 35 is consumed and the liquid level of the ink stored in the storage chamber 57 is lowered to a height equal to the position P2 in the up-down direction 7, the pivoting member 50 pivotally moves in the direction of the arrow 59 following the liquid level (liquid surface) of the ink stored in the storage chamber 160. As a result, the pivoting member 50 moves to a non-detection position indicated by a broken line in FIG. 5. That is, the pivoting member 50 is configured to change its posture (pivot) depending on whether or not the liquid level of the ink stored in the storage chamber 160 is at the same position (at the same height) as the communication port 184 in the up-down direction 7.

As described above, the pivoting member 50 is configured to pivot from the detection position to the non-detection position when the liquid level of the ink stored in the storage chamber 160 reaches the position P2 in the up-down direction 7 in the present embodiment. However, instead, the pivoting member 50 may be configured to pivot when the liquid level of the ink in the storage chamber 160 reaches a prescribed position (height) lower than the position P2.

<Liquid-Level Sensor 55>

The liquid-level sensor 55 is provided to detect the change in posture of the pivoting member 50 including the detected portion 54. In the present embodiment, each liquid-level sensor 55 includes the light-emitting portion and a light-receiving portion both mounted on a substrate 60. The light-emitting portion and the light-receiving portion are arranged spaced apart from each other in the left-right direction 9, with the projecting portion 120 of the corresponding tank 103 interposed between the light-emitting portion and the light-receiving portion. The light-emitting portion of the liquid-level sensor 55 is disposed rightward or leftward relative to the projecting portion 120, while the light-receiving portion of the liquid-level sensor 55 is disposed at the other side of the light-emitting portion with respect to the projecting portion 120. A path of light outputted from the light-emitting portion coincides with the left-right direction 9. When the pivoting member 50 is at the detection position, the detected portion 54 of the pivoting member 50 is positioned between the light-emitting portion and the light-receiving portion of the liquid-level sensor 55.

The liquid-level sensor 55 is configured to output detection different signals depending on whether or not the light outputted from the light-emitting portion is received by the light-receiving portion. For example, the liquid-level sensor 55 is configured to output a low-level signal to the controller 130 (see FIG. 12) in a case where the light-receiving portion does not receive the light outputted from the light-emitting portion (that is, an intensity of the light received at the light-receiving portion is less than a predetermined intensity). On the other hand, the liquid-level sensor 55 is configured to output a high-level signal to the controller 130 in a case where the light-receiving portion receives the light outputted from the light-emitting portion (that is, the intensity of the light received at the light-receiving portion is equal to or higher than the predetermined intensity).

The detected portion 54 is positioned between the light-emitting portion and the light-receiving portion of the corresponding liquid-level sensor 55 when the pivoting member 50 is at the detection position. Thus, in a case where the liquid level of the ink stored in the storage chamber 160 of the tank 103 (in other words, the liquid level of the ink stored in the storage chamber 57 of the ink cartridge 30) is higher than the position P2 in the up-down direction 7, the liquid-level sensor 55 outputs the low-level signal to the controller 130 since the light-receiving portion does not receive the light outputted from the light-emitting portion.

On the other hand, when the pivoting member 50 is at the non-detection position, the detected portion 54 is retracted from the position between the light-emitting portion and the light-receiving portion of the liquid-level sensor 55. Thus, in a case where the liquid level of the ink stored in the storage chamber 160 of the tank 103 (in other words, the liquid level of the ink stored in the storage chamber 57 of the ink cartridge 30) is equal to or lower than the position P2 in the up-down direction 7, the light-receiving portion can receive the light outputted from the light-emitting portion. Accordingly, the liquid-level sensor 55 outputs the high-level signal to the controller 130.

[Ink Cartridge 30]

Figure 6:
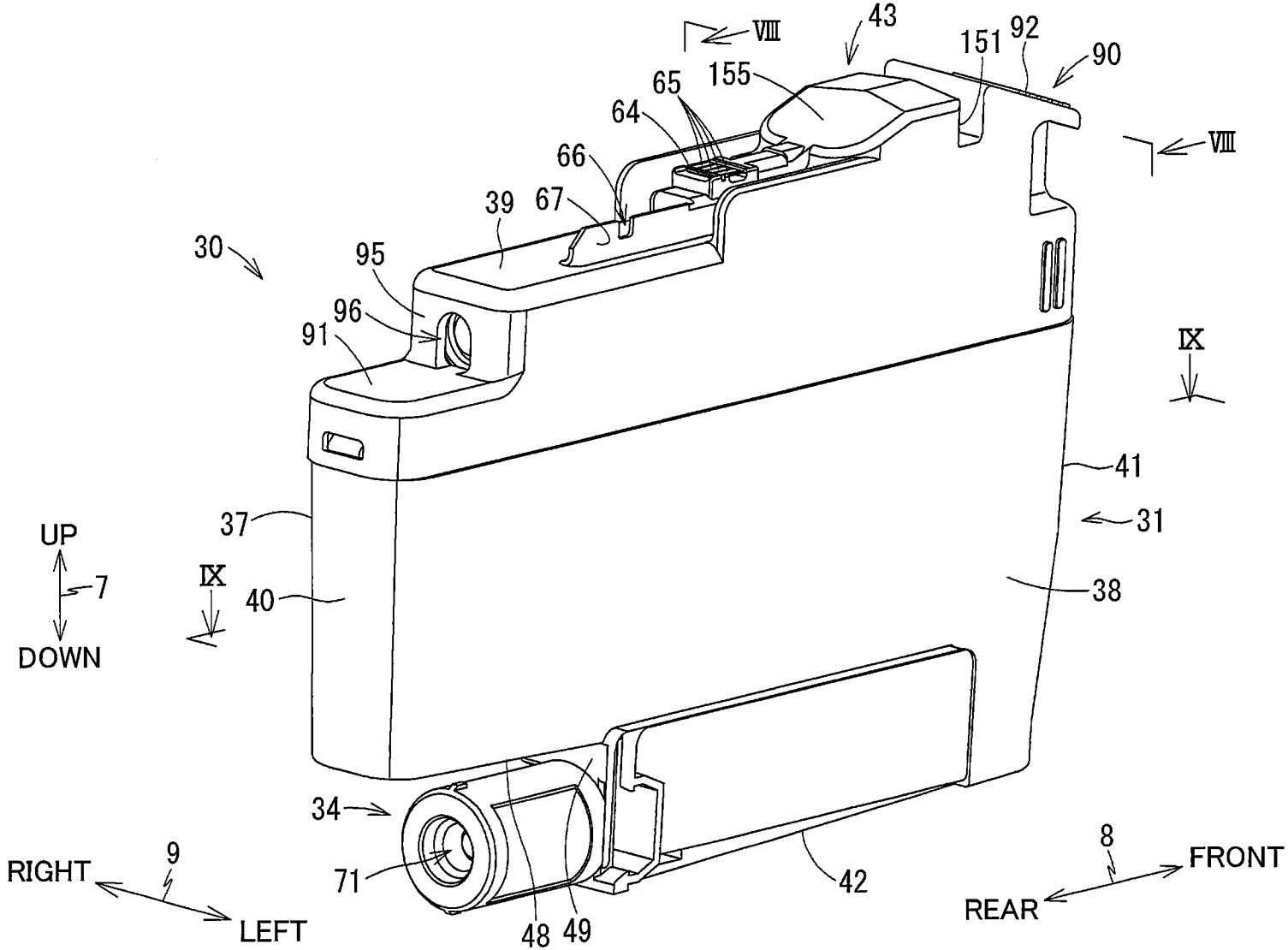
FIG. 6 is a perspective view illustrating an external appearance of the ink cartridge according to the embodiment as viewed from a front side thereof.
Figure 7:
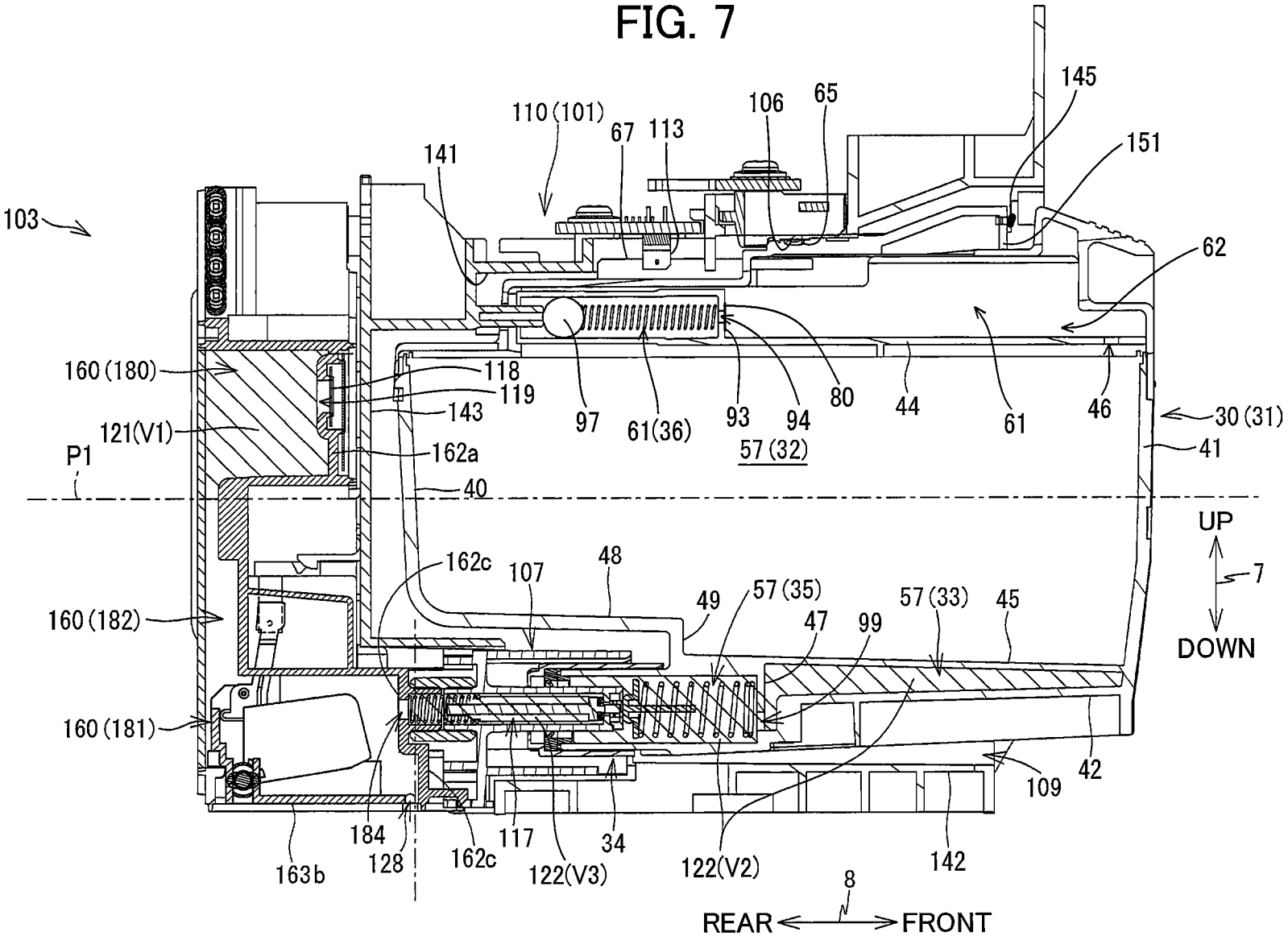
FIG. 7 is a cross-sectional view illustrating the state where the ink cartridge according to the embodiment is attached to the cartridge-attachment portion, and illustrating a volume of part of an air communication space and a volume of part of a liquid-storage space in a storage chamber of a tank of the cartridge-attachment portion.

The ink cartridge 30 illustrated in FIGS. 6 and 7 is a container for storing ink therein. The posture of the ink cartridge 30 illustrated in FIGS. 6 and 7 is the operable posture of the ink cartridge 30, that is, the posture of the ink cartridge 30 when the ink cartridge 30 is capable of being used in the multifunction peripheral 10.

As illustrated in FIGS. 6 and 7, the ink cartridge 30 includes a cartridge casing 31 that is substantially rectangular parallelepiped. The cartridge casing 31 includes a rear wall 40, a step wall 49, a step wall 95, a front wall 41, a top wall 39, a sub-top wall 91, a bottom wall 42, a sub-bottom wall 48, a right side wall 37, and a left side wall 38.

The cartridge casing 31 as a whole has a generally flattened shape so that a dimension of the cartridge casing 31 in the left-right direction 9 is small, and dimensions of the cartridge casing 31 in the up-down direction 7 and in the front-rear direction 8 are greater than the dimension of the cartridge casing 31 in the left-right direction 9. In the cartridge casing 31, at least the front wall 41 has light transmission capability so that the liquid level of the ink stored in a storage chamber 32 (described later) and the storage chamber 33 can be visually recognized from an outside of the cartridge casing 31.

The sub-bottom wall 48 is positioned upward relative to the bottom wall 42 and extends frontward continuously from a lower end of the rear wall 40. In the present embodiment, a rear end of the sub-bottom wall 48 is positioned rearward relative to a rear end of the ink supply portion 34, while a front end of the sub-bottom wall 48 is positioned frontward relative to the rear end of the ink supply portion 34. The step wall 49 connects the bottom wall 42 to the sub-bottom wall 48. The ink supply portion 34 extends rearward from the step wall 49 at a position downward relative to the sub-bottom wall 48 and upward relative to the bottom wall 42. Incidentally, the rear end of the sub-bottom wall 48 may be positioned at an arbitrary position. For example, the rear end of the sub-bottom wall 48 may be positioned frontward relative to the rear end of the ink supply portion 34.

A protruding portion 43 is provided at an outer surface of the top wall 39 to protrude upward therefrom. The protruding portion 43 extends in the front-rear direction 8. The protruding portion 43 has a lock surface 151 facing frontward. The lock surface 151 is positioned upward relative to the top wall 39. The lock surface 151 is adapted to contact the lock shaft 145 in a state where the ink cartridge 30 is attached to the cartridge-attachment portion 110. The lock surface 151 comes into contact with the lock shaft 145 while pushing the lock shaft 145 frontward, so that the ink cartridge 30 is held in the cartridge-attachment portion 110 against the urging forces of the coil springs 78 and 98.

The protruding portion 43 also has an inclined surface 155. The inclined surface 155 is positioned rearward relative to the lock surface 151. During an attachment process of the ink cartridge 30 to the cartridge-attachment portion 110, the lock shaft 145 is guided by the inclined surface 155. As the lock shaft 145 moves along the inclined surface 155, the lock shaft 145 is guided to a position capable of contacting the lock surface 151.

An operation portion 90 is disposed frontward relative to the lock surface 151 on the top wall 39. The operation portion 90 has an operation surface 92. When the operation surface 92 is pushed downward in the state where the ink cartridge 30 is attached to the cartridge-attachment portion 110, the ink cartridge 30 is pivotally moved, thereby moving the lock surface 151 downward. As a result, the lock surface 151 is positioned further downward relative to the lock shaft 145. In this way, the ink cartridge 30 can be extracted from the cartridge-attachment portion 110.

The light-blocking plate 67 is provided at the outer surface of the top wall 39 to protrude upward therefrom. The light-blocking plate 67 extends in the front-rear direction 8. The light-blocking plate 67 is disposed rearward relative to the protruding portion 43.

The light-blocking plate 67 is arranged to be located between the light-emitting portion and the light-receiving portion of the attachment sensor 113 in a state where the ink cartridge 30 is attached to the cartridge-attachment portion 110. Hence, the light-blocking plate 67 can block the light of the attachment sensor 113 traveling in the left-right direction 9.

More specifically, when the light emitted from the light-emitting portion of the attachment sensor 113 is incident on the light-blocking plate 67 before the light arrives at the light-receiving portion of the attachment sensor 113, an intensity of the light received by the light-receiving portion is less than a predetermined intensity, for example, zero. Note that the light-blocking plate 67 may completely block the light traveling from the light-emitting portion to the light-receiving portion, or may partially attenuate the light. Alternatively, the light-blocking plate 67 may refract the light to change a traveling direction thereof, or may fully reflect the light.

In the present embodiment, a notch 66 is formed in the light-blocking plate 67. The notch 66 is a space that is recessed downward from an upper edge of the light-blocking plate 67, and extends in the front-rear direction 8. The notch 66 is formed in the light-blocking plate 67 at a position opposing the attachment sensor 113 in the state where the ink cartridge 30 is attached to the cartridge-attachment portion 110. Hence, the light emitted from the light-emitting portion of the attachment sensor 113 passes through the notch 66 and is therefore not blocked by the light-blocking plate 67 in the state where the ink cartridge 30 is attached to the cartridge-attachment portion 110. Accordingly, the light emitted from the light-emitting portion of the attachment sensor 113 reaches the light-receiving portion of the attachment sensor 113.

On the other hand, in a case where the notch 66 is not formed in the light-blocking plate 67, the light-blocking plate 67 opposes the light-emitting portion of the attachment sensor 113 in the state where the ink cartridge 30 is attached to the cartridge-attachment portion 110. Accordingly, the light emitted from the light-emitting portion of the attachment sensor 113 does not reach the light-receiving portion of the attachment sensor 113. With this structure, types of the ink cartridges 30, such as types of ink stored in the ink cartridges 30, and initial amounts of ink stored in the ink cartridges 30 can be determined based on whether or not the notch 66 is formed in the light-blocking plate 67 of the ink cartridge 30 attached to the cartridge-attachment portion 110.

An IC board 64 is also provided at the outer surface of the top wall 39 at a position between the light-blocking plate 67 and the protruding portion 43 in the front-rear direction 8. The IC board 64 is electrically connected to the corresponding set of contacts 106 in the state where the ink cartridge 30 is attached to the cartridge-attachment portion 110.

The IC board 64 includes a substrate made of silicon for example, the IC (not illustrated), and the four electrodes 65. The IC and the four electrodes 65 are mounted on the substrate. The four electrodes 65 are arrayed in the left-right direction 9. The IC is a semiconductor integrated circuit. The IC readably stores data indicative of information on the ink cartridge 30, such as a lot number, a manufacturing date, a color of ink, and the like. Alternatively, the IC board 64 may be configured by providing the IC and electrodes on a flexible substrate having flexibility.

Each of the four electrodes 65 is electrically connected to the IC. Each electrode 65 extends in the front-rear direction 8. The electrodes 65 are arranged spaced apart from one another in the left-right direction 9. The electrodes 65 are provided on an upper surface of the IC board 64 and exposed thereon to an outside to allow electrical access to the electrodes 65.

The step wall 95 extends upward from a front end of the sub-top wall 91 that is positioned rearward relative to the top wall 39. The step wall 95 is formed with the air communication port 96 to allow the storage chamber 32 to communicate with the atmosphere. In other words, the air communication port 96 is positioned higher relative to the center of the cartridge casing 31 in the up-down direction 7. The air communication port 96 is a substantially circular-shaped opening formed in the step wall 95. The air communication port 96 has an inner diameter that is greater than an outer diameter of the rod 125 of the cartridge-attachment portion 110.

In the attachment process of the ink cartridge 30 into the cartridge-attachment portion 110, the rod 125 enters the air communication port 96, as depicted in FIG. 5. As the rod 125 passes through the air communication port 96, the rod 125 moves a valve 97 sealing the air communication port 96 frontward against the urging force of the coil spring 98. As the valve 97 is moved frontward to be separated from the air communication port 96, the storage chamber 32 is open to the atmosphere.

Incidentally, a member for sealing the air communication port 96 may not necessarily be the valve 97. For example, a peel-off seal may be provided at the step wall 95 to seal the air communication port 96.

As illustrated in FIG. 5, the storage chamber 57, an air flow path 61 and an ink buffer chamber 62 are provided within the cartridge casing 31. The storage chamber 57 includes the storage chamber 32, the storage chamber 33, and the ink valve chamber 35. The storage chamber 32 and storage chamber 33 store ink therein.

Inside the cartridge casing 31, a partition wall 44 and an inner bottom wall 45 are provided. The partition wall 44 and inner bottom wall 45 both extend in the front-rear direction 8 and left-right direction 9. The partition wall 44 and inner bottom wall 45 are arranged to oppose each other in the up-down direction 7.

The storage chamber 32 is a space defined by: a lower surface of the partition wall 44; upper surfaces of the inner bottom wall 45 and sub-bottom wall 48; inner surfaces of the front wall 41, rear wall 40 and step wall 49; and inner surfaces of the right side wall 37 and left side wall 38. Specifically, the lower surface of the partition wall 44 defines an upper edge of the storage chamber 32; the upper surfaces of the inner bottom wall 45 and sub-bottom wall 48 define a lower edge of the storage chamber 32; the inner surfaces of the front wall 41 define a front edge of the storage chamber 32; the inner surfaces of the rear wall 40 and step wall 49 define a rear edge of the storage chamber 32; and the inner surfaces of the right side wall 37 and left side wall 38 define a right edge and a left edge of the storage chamber 32, respectively.

The partition wall 44 separates the storage chamber 32 from the air flow path 61. The partition wall 44 has a front end portion that is formed with a through-hole 46. The storage chamber 32 and the air flow path 61 are in communication with each other through the through-hole 46.

The inner bottom wall 45 extends frontward from the inner surface of the step wall 49. The inner bottom wall 45 partitions the storage chamber 57 into the storage chamber 32 (above the inner bottom wall 45) and the storage chamber 33 (below the inner bottom wall 45). The inner bottom wall 45 has a front end portion in which a communication opening 45*a* is formed (see FIGS. 9, 10A and 10B). The storage chamber 32 and the storage chamber 33 are in communication with each other through the communication opening 45*a*. As depicted in FIG. 10A, the communication opening 45*a* has a generally rectangular shape in a top view (when viewed in the up-down direction 7).

Figure 9:
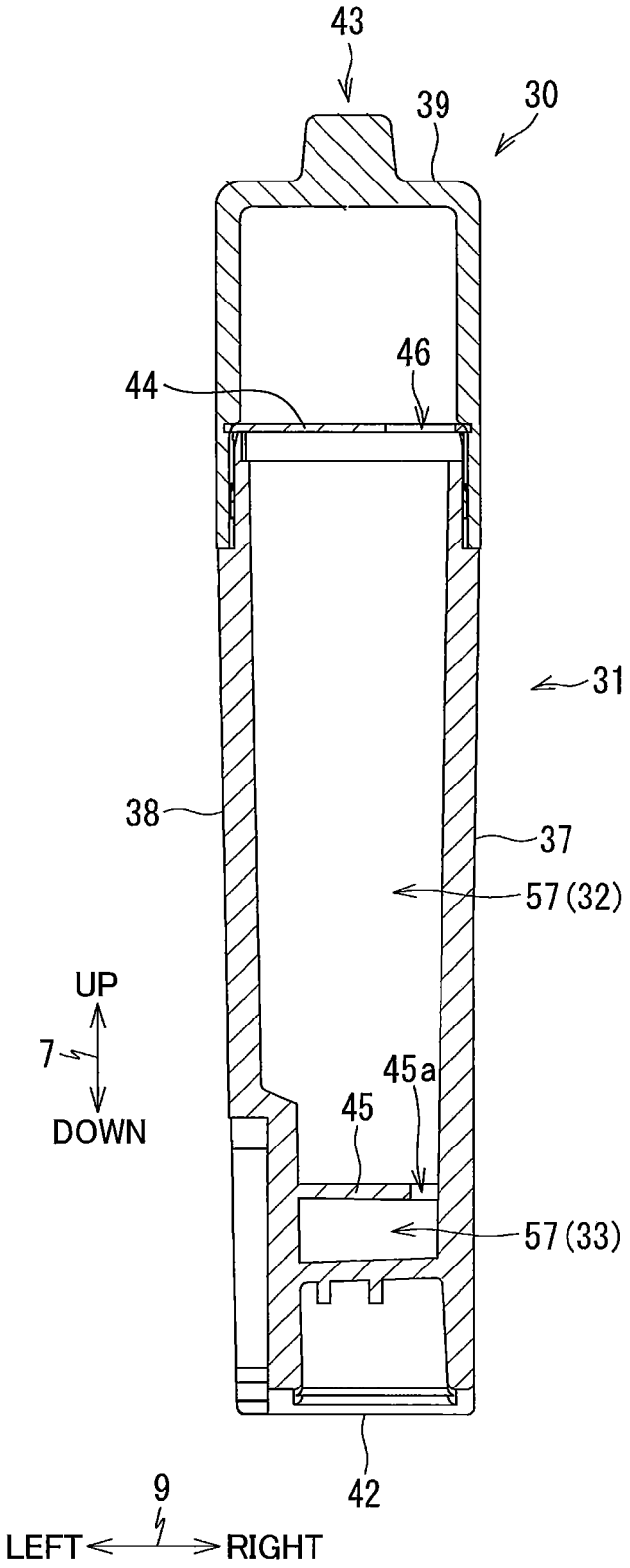
FIG. 9 is a cross-sectional view of the ink cartridge according to the embodiment taken along a plane VIII-VIII shown in FIG. 6.
Figure 10A:
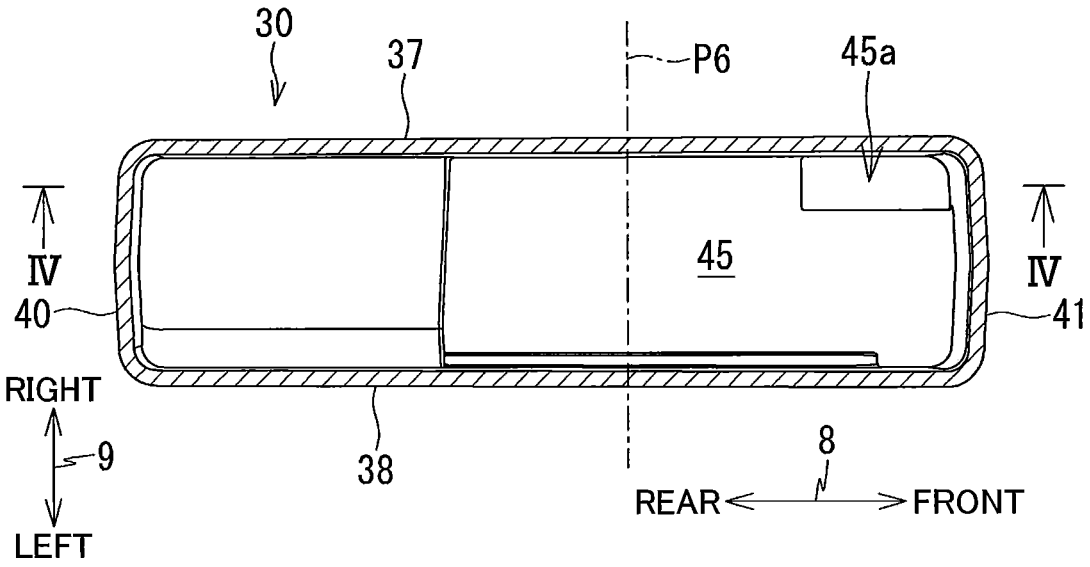
FIG. 10A is a cross-sectional view of the ink cartridge according to the embodiment taken along a horizontal plane IX-IX shown in FIG. 6.

As illustrated in FIGS. 9 and 10A, a left end of the inner bottom wall 45 is connected to the left side wall 38. That is, the inner bottom wall 45 extends rightward from an inner surface of the left side wall 38, i.e., from a surface facing rightward and defining the storage chamber 32. The communication opening 45*a* is formed in a right end portion of the inner bottom wall 45 in the left-right direction 9. As illustrated in FIG. 9, a left edge of the communication opening 45*a* is positioned rightward relative to a left edge of the through-hole 46 in the left-right direction 9.

Note that the through-hole 46 may be positioned leftward relative to the communication opening 45*a*. Specifically, a right edge of the through-hole 46 may be positioned leftward relative to the left edge of the communication opening 45*a*.

As illustrated in FIG. 5, the inner bottom wall 45 is positioned upward relative to the ink supply port 71 of the ink supply portion 34.

The storage chamber 33 is located below the storage chamber 32 inside the cartridge casing 31 in the operable posture of the ink cartridge 30. The storage chamber 33 has a volume (a maximum amount of ink that the storage chamber 33 can store therein) that is smaller than a volume of the storage chamber 32 (a maximum amount of ink that the storage chamber 32 can store therein).

A lower surface of the inner bottom wall 45 defines an upper edge of the storage chamber 33.

An upper surface of the bottom wall 42 defines a lower edge of the storage chamber 33. The inner surface of the front wall 41 defines a front edge of the storage chamber 33. The inner surfaces of the right side wall 37 and left side wall 38 define a right edge and a left edge of the storage chamber 33, respectively. A partitioning wall 47 is also formed inside the cartridge casing 31 to separate the storage chamber 33 from the ink valve chamber 35 in the front-rear direction 8. A front surface of the partitioning wall 47 defines a rear edge of the storage chamber 33. The partitioning wall 47 is formed with a through-hole 99.

In other words, the storage chamber 33 is a space defined by the lower surface of the inner bottom wall 45, the upper surface of the bottom wall 42, the inner surface of the front wall 41, the inner surfaces of the right side wall 37 and left side wall 38 and the front surface of the partitioning wall 47. The storage chamber 33 is in communication with the ink valve chamber 35 through the through-hole 99.

The air flow path 61 is configured to allow the storage chamber 57 to communicate with the atmosphere. The air flow path 61 has one end portion (front end portion) in communication with the storage chamber 32 via the through-hole 46, and another end portion (rear end portion) in communication with the atmosphere via the air communication port 96.

An air valve chamber 36 constitutes the other end portion (rear end portion) of the air flow path 61. The air valve chamber 36 is in communication with the outside through the air communication port 96. Within the air valve chamber 36, the valve 97 and the coil spring 98 are accommodated. The valve 97 is movable between a closed position and an open position.

At the closed position, the valve 97 seals the air communication port 96. At the open position, the valve 97 is separated from the air communication port 96. The coil spring 98 is disposed in the air valve chamber 36 so as to be capable of expanding and contracting in the front-rear direction 8. The coil spring 98 urges the valve 97 rearward, i.e., in such a direction that the valve 97 contacts the air communication port 96. The coil spring 98 has a spring constant that is smaller than a spring constant of the coil spring 78 of the ink supply portion 34.

A wall 93 partitions the air valve chamber 36 from the one end portion (front end portion) of the air flow path 61. The wall 93 is formed with a through-hole 94. The through-hole 94 is sealed by a semipermeable membrane 80. With this structure, air can pass through the semipermeable membrane 80 but ink is prevented from flowing through the semipermeable membrane 80. The air valve chamber 36 is in communication with the one end portion (front end portion) of the air flow path 61 through the through-hole 94.

The ink buffer chamber 62 is provided between the one end portion (front end portion) and the other end portion (rear end portion) of the air flow path 61. More specifically, the ink buffer chamber 62 is provided between the through-hole 94 and the through-hole 46 in the air flow path 61. One end (front end) of the ink buffer chamber 62 is in communication with the one end portion of the air flow path 61 (i.e., the front end portion communicating with the storage chamber 32 through the through-hole 46). Another end (rear end) of the ink buffer chamber 62 is in communication with the other end portion of the air flow path 61 (i.e., the rear end portion communicating with the air valve chamber 36 through the through-hole 94). The storage chamber 32 can thus communicate with the atmosphere through the air flow path 61 and ink buffer chamber 62.

In the present embodiment, a resistance of an air flow path that allows the storage chamber 160 of each tank 103 to communicate with the atmosphere (i.e., the air flow path 147 connecting the through-hole 119 to the corresponding air communication port 124, depicted in FIG. 4) is greater than a resistance of an air flow path that allows the storage chamber 57 of the ink cartridge 30 to communicate with the atmosphere (i.e., the air flow path 61 and ink buffer chamber 62).

Conceivably, passage resistance can be made smaller by enlarging a cross-sectional area of a passage. Also, passage resistance can be increased by making a length of a passage longer, for example. Alternatively, passage resistance can be made either smaller or larger by changing types of a semipermeable membrane that seals a passage. Still alternatively, passage resistance can become larger by increasing a number of semipermeable membranes that may be provided in a passage.

Note that the passage resistance of the air flow path 147 that allows communication of the storage chamber 160 of each tank 103 with the atmosphere may be equal to or smaller than the passage resistance of the air flow path that allows communication of the storage chamber 57 of the ink cartridge 30 with the atmosphere (i.e., the air flow path 61 and ink buffer chamber 62).

The ink supply portion 34 protrudes rearward from the step wall 49. That is, the ink supply portion 34 is provided at the step wall 49. The ink supply portion 34 has a cylindrical outer shape. The ink supply portion 34 has an inner space serving as the ink valve chamber 35. The ink supply portion 34 has a rear end portion that is open to the outside of the ink cartridge 30 through the ink supply port 71. A seal member 76 is provided at the rear end portion of the ink supply portion 34. The ink supply portion 34 has a front end that is in communication with a lower end portion of the storage chamber 33 through the through-hole 99 as described above. That is, the ink supply portion 34 is in communication with the lower end portion of the storage chamber 33. Put another way, the ink supply port 71 is in communication with the storage chamber 33 via the ink valve chamber 35.

The ink valve chamber 35 is defined by inner peripheral surfaces of the ink supply portion 34. Referring to FIG. 5, the inner peripheral surface defining a lower end of the ink supply portion 34 (to be referred as "inner lower end 34*a*") defines a bottom (lowermost end) of the storage chamber 57. On the other hand, a lower wall 163*b* defining a bottom of the first chamber 181 defines a bottom (lowermost end) of the storage chamber 160 of the tank 103. The lower wall 163*b* is positioned downward relative to the inner lower end 34*a* of the ink supply portion 34.

A valve 77 and the coil spring 78 are accommodated in the ink valve chamber 35. The valve 77 is movable in the front-rear direction 8 to open and close the ink supply port 71 penetrating a center portion of the seal member 76. The coil spring 78 urges the valve 77 rearward. Accordingly, the valve 77 closes off the ink supply port 71 formed in the seal member 76 in a state where no external force is applied to the valve 77.

The seal member 76 is a disk-shaped member whose center portion is formed with a through-hole. The seal member 76 is made of an elastic material such as rubber or elastomer, for example. A cylindrical inner peripheral surface defining the through-hole penetrating the center portion of the seal member 76 in the front-rear direction 8 defines the ink supply port 71. The ink supply port 71 has an inner diameter slightly smaller than an outer diameter of the ink needle 102.

While the ink cartridge 30 is being attached to the cartridge-attachment portion 110 in a state where the valve 77 closes off the ink supply port 71 and the valve 114 closes the opening 116 of the ink needle 102, the ink needle 102 enters into the ink supply port 71 in the front-rear direction 8. That is, the connecting portion 107 and the ink supply portion 34 are connected to each other during the attachment process of the ink cartridge 30 to the cartridge-attachment portion 110. At this time, the outer peripheral surface of the ink needle 102 provides liquid-tight contact with the inner peripheral surface of the seal member 76 that defines the ink supply port 71, while elastically deforming the seal member 76. As the tip end of the ink needle 102 passes through the seal member 76 and advances into the ink valve chamber 35, the tip end of the ink needle 102 abuts on the valve 77. As the ink cartridge 30 is further inserted into the cartridge-attachment portion 110, the ink needle 102 moves the valve 77 frontward against the urging force of the coil spring 78, thereby opening the ink supply port 71.

While the tip end of the ink needle 102 abuts on the valve 77, the valve 77 abuts on the valve 114 from a front side thereof and pushes the valve 114 rearward. The valve 114 thus moves rearward against the urging force of the coil spring 115, thereby opening the opening 116 of the ink needle 102. As a result, the ink stored in the storage chamber 32, the storage chamber 33 and the ink valve chamber 35 is allowed to flow into the storage chamber 160 of the corresponding tank 103 through the internal space 117 of the ink needle 102. Here, each of the storage chamber 32, the storage chamber 33, the ink valve chamber 35 and the storage chamber 160 is open to the atmosphere. Accordingly, the ink stored in the storage chamber 32, the storage chamber 33 and the ink valve chamber 35 of the ink cartridge 30 is supplied to the storage chamber 160 of the corresponding tank 103 through the ink supply portion 34 due to hydraulic head difference.

Referring to FIG. 7, the air communication space of the storage chamber 160 (the portion above the position P1) has a portion 121 that is positioned rearward relative to the communication port 128. This portion 121 is illustrated by a hatching in FIG. 7. The portion 121 has a volume V1 larger than a volume of a portion 122 that is also illustrated by another hatching in FIG. 7. The portion 122 is a sum of: the storage chamber 33 and ink valve chamber 35 of the ink cartridge 30; and a portion of the liquid-storage space (the portion below the position P1) of the storage chamber 160 positioned frontward relative to the communication port 128. That is, the volume of the portion 122 is a sum of: a volume V2 of the storage chamber 33 and ink valve chamber 35; and a volume V3 of the portion of the liquid-storage space of the storage chamber 160 positioned frontward relative to the communication port 128.

Note that, although the portion 122 is depicted to have a larger area than the portion 121 is in FIG. 6, the volume V1 of the portion 121 is actually larger than the volume of the portion 122 (V2+V3), since the portion 122 has a smaller dimension than the portion 121 in the left-right direction 9.

As described above, in the operable posture of the multifunction peripheral 10, the liquid level of the ink is at the position P1 in the state where the predetermined maximum amount of ink is stored in the tank 103 and ink cartridge 30. Here, assume that the multifunction peripheral 10 in the operable posture now changes its posture such that a rear surface of the casing 14 in the operable posture is placed on a horizontal plane (hereinafter, to be referred to as "rear-surface-down posture"). When the multifunction peripheral 10 is placed in the rear-surface-down posture, the liquid level of the ink in each ink cartridge 30 comes to a position P6 shown in FIGS. 10A and 10B. In this state (in the rear-surface-down posture), the communication opening 45*a* formed in the inner bottom wall 45 is positioned upward of the position P6 (i.e., frontward of the position P6 in the operable posture). In other words, the communication opening 45*a* is positioned higher than the liquid level provided by the predetermined maximum amount of ink stored in the storage chamber 57 in a state where the multifunction peripheral 10 is disposed in such an orientation that inner surfaces of the rear wall 40 and step wall 49 face upward (i.e., in the rear-surface-down posture).

[Controller 130]

Figure 8:
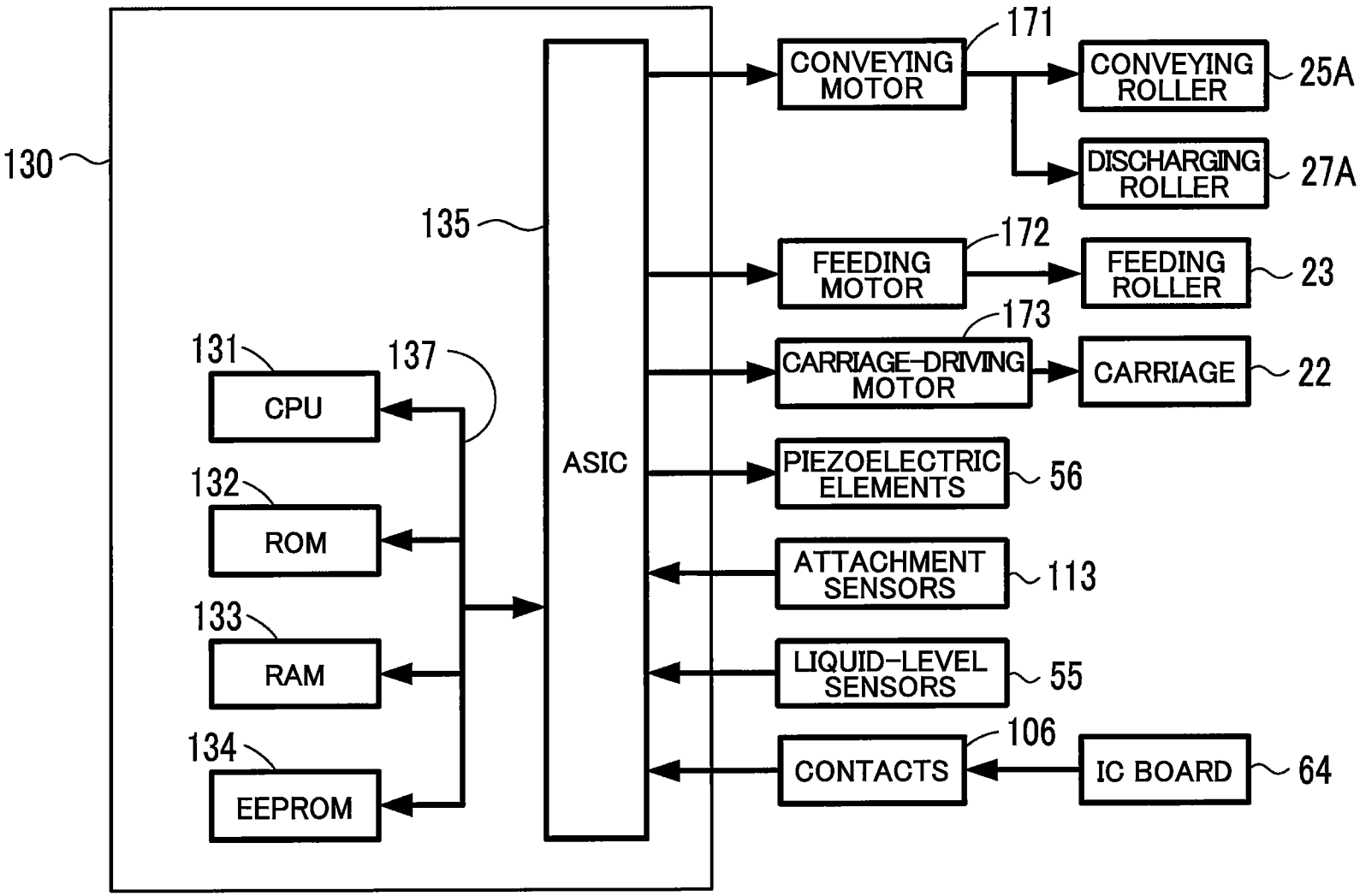
FIG. 8 is a block diagram illustrating an internal configuration of a controller of the multifunction peripheral according to the embodiment.

Next, an overall configuration of the controller 130 will be described with reference to FIG. 8. The multifunction peripheral 10 includes the controller 130. The controller 130 is configured to control overall operations of the multifunction peripheral 10. The controller 130 includes a CPU 131, a ROM 132, a RAM 133, an EEPROM 134, an ASIC 135, and an internal bus 137 that connects these components to one another.

The ROM 132 stores programs and the like according to which the CPU 131 can perform various control operations including an image-recording control operation. The RAM 133 is used as a storage area for temporarily storing data, signals, and the like used when the CPU 131 executes the programs. The EEPROM 134 stores settings, flags, and the like that need to be preserved after the multifunction peripheral 10 is turned off.

The conveying motor 171, the feeding motor 172, and the carriage-driving motor 173 are connected to the ASIC 135. The ASIC 135 includes drive circuits for controlling these motors. When the CPU 131 inputs a drive signal for rotating each motor into a corresponding drive circuit thereof, a drive current corresponding to the drive signal is outputted from the drive circuit to the corresponding motor to rotate the motor. That is, the controller 130 is configured to control rotations of the motors 171, 172 and 173.

The piezoelectric elements 56 are also connected to the ASIC 135. The piezoelectric elements 56 are configured to operate upon receipt of electric power supplied by the controller 130 through a drive circuit (not illustrated). The controller 130 is thus configured to control power supply to the piezoelectric elements 56 so that ink droplets can be selectively ejected through the plurality of nozzles 29.

The controller 130 is configured to control the conveying motor 171 to cause the conveying rollers 25 and the discharging rollers 27 to execute an intermittent conveying process when performing image recordation on the sheets 12. The intermittent conveying process is a process in which the conveying rollers 25 and the discharging rollers 27 alternately repeat conveyance of the sheet 12 and halting of the conveyance of the sheet 12 by prescribed line feeds.

The controller 130 executes an ejection process while halting the conveyance of the sheet 12 in the intermittent conveying process. The ejection process is a process in which the controller 130 controls the power supply to the piezoelectric elements 56 to allow ink droplets to be ejected from the nozzles 29 while moving the carriage 22 in the left-right direction 9. By alternately performing the intermittent conveying process and the ejection process, an image is recorded on each sheet 12.

Further, signals outputted from the attachment sensors 113 are configured to be inputted into the ASIC 135. In a case where a low signal is inputted from one attachment sensor 113, the controller 130 determines that the ink cartridge 30 has been attached to the cartridge-attachment portion 110. On the other hand, the controller 130 determines that the ink cartridge 30 has not been attached to the cartridge-attachment portion 110 in a case where a high level signal is inputted from the attachment sensor 113.

Signals outputted from the liquid-level sensors 55 are also configured to be inputted into the ASIC 135. When a low level signal is inputted from the liquid-level sensor 55, the controller 130 determines that the liquid level of the ink stored in the storage chamber 160 of the tank 103 and the liquid level of the ink stored in the ink cartridge 30 are positioned higher than the position P2 in the up-down direction 7.

At a timing when the signal inputted from the liquid-level sensor 55 changes from low level to high level due to the change in posture of the pivoting member 50, the controller 130 determines that the liquid level of the ink stored in the storage chamber 160 of the tank 103 and the liquid level of the ink stored in the ink cartridge 30 are located at the position P2 in the up-down direction 7.

At this timing, the controller 130 notifies a user that only a small amount of ink or no ink is left in the attached ink cartridge 30, by means of displaying some kind of warning message on the display 200 (see FIG. 1), lighting an LED light, or emitting a buzzer sound, for example, so that the user can be informed that the ink cartridge 30 needs to be replaced.

Incidentally, the controller 130 may be configured to count how many dots of ink droplets are ejected from the recording head 21 after the signal outputted from the liquid-level sensor 55 to the controller 130 switches from the low level signal to the high level signal. In this case, the controller 130 may determine that the liquid level of the ink stored in the storage chamber 160 of the tank 103 and the liquid level of the ink stored in the corresponding ink cartridge 30 are at a prescribed position lower than the position P2 in the up-down direction 7 when the number (value) of the counted dots is greater than or equal to a predetermined value. At this time, the controller 130 may also notify the user about a residual amount of ink left in the storage chamber 160 in the similar manner as described above. Incidentally, the predetermined value may be determined on a basis of a volume of a portion of the storage chamber 160 poisoned lower than the connecting portion 107.

[Withstand Pressure of Meniscus Formed at the Communication Opening 45*a*]

As described above, in the state where the predetermined maximum amount of ink is stored in the storage chamber 57 of the ink cartridge 30, the liquid surface of the ink is located at the position P1 in the up-down direction 7, as depicted in FIG. 7. As the ink is consumed by being ejected through the nozzles 29 of the recording head 21, the liquid surface of the ink in the storage chamber 57 is gradually lowered.

As the liquid surface of the ink in the storage chamber 57 falls down to reach the communication opening 45*a* formed in the inner bottom wall 45, a meniscus may be formed at the communication opening 45*a*. Normally, as the liquid surface of the ink in the storage chamber 160 falls down in accordance with consumption of the ink at the recording head 21, the ink flows into the storage chamber 160 of the tank 103 from the corresponding storage chamber 33 and ink valve chamber 35 due to the water head difference.

However, if the meniscus formed at the communication opening 45*a* has a withstand pressure (capacity to withstand pressure) greater than the water head difference, the ink cannot flow into the storage chamber 160 from the storage chamber 33 and ink valve chamber 35 despite the decline in liquid level of the ink stored in the storage chamber 160. Hence, as the ink is consumed at the recording head 21, the liquid surface of the ink stored in the storage chamber 160 of the tank 103 would decline, although the ink remains in the storage chamber 33 and ink valve chamber 35. When the liquid level in the storage chamber 160 falls down to the position P2 thereafter, the pivoting member 50 is caused to pivot to change the signal outputted from the liquid-level sensors 55 from low level to high level. As a result, the controller 130 may display on the display 200 a message prompting a user to replace the ink cartridge 30 or informing the user that little ink is left in the storage chamber 160, despite a fact that the ink is still left in the storage chamber 33 and ink valve chamber 35 at this moment.

In the present embodiment, the withstand pressure of the meniscus formed at the communication opening 45*a*, water head difference, and passage resistance are designed to satisfy an inequality (2) shown below:

$$Pm<\rho\cdot Hs\cdot g-Ic(Rn-Rc+Rs) \qquad \text{inequality (2)},$$

where:

Pm: withstand pressure of the meniscus at the communication opening 45*a;*

ρ: density of the liquid;

Hs: length (distance) in the up-down direction 7 between the liquid level of the liquid in the storage chamber 160 detected by the liquid-level sensor 55 (i.e., the liquid level at the prescribed position P2) and the communication opening 45*a;* g: gravitational acceleration;

Ic: flow rate of the liquid flowing into the storage chamber 160 from the storage chamber 57 when the liquid surface of the ink in the storage chamber 57 is at the communication opening 45*a* and the liquid surface of the ink in the storage chamber 160 is located at the prescribed position P2 in the up-down direction 7;

Rn: passage resistance at the internal space 117 of the ink needle 102;

Rc: passage resistance provided by the semipermeable membrane 80; and

Rs: passage resistance provided by the semipermeable membrane 118.

Here, the withstand pressure of the meniscus formed at the communication opening 45*a* (Pm) is defined as a difference between a pressure applied to the meniscus from the ink and a pressure applied to the meniscus from the atmosphere. The meniscus does not break as long as the meniscus is applied with a pressure smaller than this difference.

The water head difference is calculated as a product of the density of the liquid (ρ), gravitational acceleration (g), and the length (distance) in the up-down direction 7 between the communication opening 45*a* and the liquid level of the liquid in the storage chamber 160 at the prescribed position P2 (Hs). The prescribed position P2 is between a position corresponding to the communication opening 45*a* and the ink supply port 71 in the up-down direction 7.

The passage resistance at the internal space 117 of the ink needle 102 (Rn) is calculated as a passage resistance provided by a passage extending from the opening 116 at the front end of the ink needle 102 to the communication port 184 communicating with the storage chamber 160.

The passage resistances of the semipermeable membranes 80 and 118 are calculated based on respective Gurley numbers.

According to the inequality (2) of the present embodiment, the withstand pressure of the meniscus of ink formed at the communication opening 45*a* (Pm) is smaller than a value obtained by subtracting, from the water head difference when the liquid surface of the ink in the storage chamber 57 of the ink cartridge 30 is at the communication opening 45*a* and the liquid surface of the ink in the storage chamber 160 is located at the prescribed position P2 in the up-down direction 7 (ρ·Hs·g), a product of: the flow rate of the ink flowing into the storage chamber 160 from the storage chamber 57 when the above water head difference is generated (Ic); and a difference between the passage resistance at the internal space 117 of the ink needle 102 (Rn) and a sum of the passage resistances of the semipermeable membranes 80 and 118 (Rc+Rs).

With this configuration, the meniscus formed at the communication opening 45*a* can be reliably broken by when the liquid surface of the ink in the storage chamber 160 reaches the position P2.

[Operational and Technical Advantages of the Embodiment]

According to the structure of the depicted embodiment, there remain little chances that ink is left in a lower portion of the storage chamber 57 (i.e., in the storage chamber 33 and ink valve chamber 35) when the signal outputted from the liquid-level sensors 55 changes from low level to high level. Hence, even if a meniscus (menisci) is formed at the communication opening 45*a*, the liquid-level sensors 55 can accurately detect the liquid level of the ink stored in the storage chamber 160 of the corresponding tank 103.

Further, since the passage resistance of the semipermeable membrane 80 in the ink cartridge 30 is smaller than the passage resistance of the semipermeable membrane 118 belonging to the tank 103, the ink the ink stored in the storage chamber 57 of the ink cartridge 30 is easier to flow into the recording head 21 when the recording head 21 ejects the ink through the nozzles 29 than the ink stored in the storage chamber 160 of the tank 103 flows into the recording head 21 does. Hence, the ink is further less likely to remain in the lower portion of the storage chamber 57 (the storage chamber 33 and ink valve chamber 35) while the liquid level of the ink in the storage chamber 160 declines from the position corresponding to the communication opening 45*a* to the position P2 and the liquid level at the position P2 is detected by the liquid-level sensor 55.

Further, a meniscus is less likely to be formed at the communication opening 45*a* due to the substantially rectangular outer shape of the communication opening 45*a* in a top view. Even if a meniscus is formed at the communication opening 45*a*, the withstand pressure of the meniscus can be made relatively small.

Further, in the present embodiment, the pivoting member 50 changes its posture (pivots) to change the signal outputted from the liquid-level sensor 55 from low level to high level when the liquid level of the ink in the storage chamber 160 reaches the position P2. Hence, in the storage chamber 57 of the ink cartridge 30, there remains little ink to be supplied to the storage chamber 160 when the signal from the liquid-level sensor 55 changes from low level to high level.

In the operable posture of the multifunction peripheral 10, the storage chamber 160 is positioned frontward of the nozzles 29 of the recording head 21, as illustrated in FIG. 3. Here, assume that the multifunction peripheral 10 is rotated by 90 degrees from its operable posture into a rotated posture in which the storage chamber 160 is positioned upward of the nozzles 29 of the recording head 21. That is, in the rotated posture, the multifunction peripheral 10 is placed on a horizontal place with a rear surface of the casing 14 in the operable posture placed on the horizontal plane to serve as the bottom surface of the casing 14. When the multifunction peripheral 10 is placed in the rotated posture, the ink stored in the storage chamber 160 may flow into the recording head 21 through the communication port 128 due to the water head difference, which may cause leakage of ink through the nozzles 29.

However, in the present embodiment, the air communication space in the storage chamber 160 is positioned upward of the liquid-storage space in the operable posture of the multifunction peripheral 10. Accordingly, when the posture of the multifunction peripheral 10 is changed into the rotated posture from the operable posture, the air communication space and liquid-storage space are horizontally aligned with each other in the storage chamber 160. The ink stored in the liquid-storage space thus flows into the air communication space. As a result, the ink stored in the storage chamber 160 in the operable posture is less likely to flow out of the storage chamber 160 through the communication port 128, thereby reducing an amount of ink outflow through the communication port 128 in the rotated posture.

Still further, when the multifunction peripheral 10 is placed into the rotated posture from the operable posture, the ink in the storage chamber 57 may flow into the storage chamber 160 through the ink supply port 71. The ink having flowed in the storage chamber 160 may then flow into the recording head 21 through the communication port 128 due to the water head difference, possibly resulting in leakage of ink through the nozzles 29 of the recording head 21. However, in the present embodiment, the storage chamber 57 is partitioned by the inner bottom wall 45 into an upper portion (storage chamber 32) and the lower portion (storage chamber 33 and ink valve chamber 35). With this structure, when the multifunction peripheral 10 is placed in the rotated posture, of the ink stored in the upper portion (storage chamber 32) of the storage chamber 57, the ink positioned below the communication opening 45*a* in the rotated posture cannot move into the lower portion of the storage chamber 57 and thus cannot flow into the storage chamber 160 of the tank 103. Hence, this structure can reduce the amount of ink that may flow into the storage chamber 160 in the rotated posture of the multifunction peripheral 10.

Still further, when the posture of the multifunction peripheral 10 is changed into the rotated posture from the operable posture, following ink may possibly flow into the recording head 21 from the tank 103 through the communication port 128: the ink stored in the lower portion of the storage chamber 57 (the ink stored in storage chamber 33 and ink valve chamber 35); the ink stored in the upper portion (storage chamber 32) of the storage chamber 57 and positioned above the communication opening 45*a* in the rotated posture of the multifunction peripheral 10 (i.e., frontward of the communication opening 45*a* in the operable posture); the ink stored in the liquid-storage space of the storage chamber 160 and positioned above the communication port 128 in the rotated posture of the multifunction peripheral 10 (i.e., frontward of the communication port 128 in the operable posture).

In the present embodiment, the volume V1 of the hatched portion 121 (the portion of the air communication space positioned rearward of the communication port 128 in the storage chamber 160) is larger than the sum of the volume V2 (the volume of the lower portion of the storage chamber 57) and the volume V3 (the volume of portion of the liquid-storage space positioned frontward relative to the communication port 128 in storage chamber 160). That is, the volume V1 of the portion 121 is greater than the volume of the hatched portion 122. This structure of the present embodiment can reduce the amount of ink that may flow out of the storage chamber 160 through the communication port 128 when the posture of the multifunction peripheral 10 is changed into the rotated posture from the operable posture.

Figure 10B:
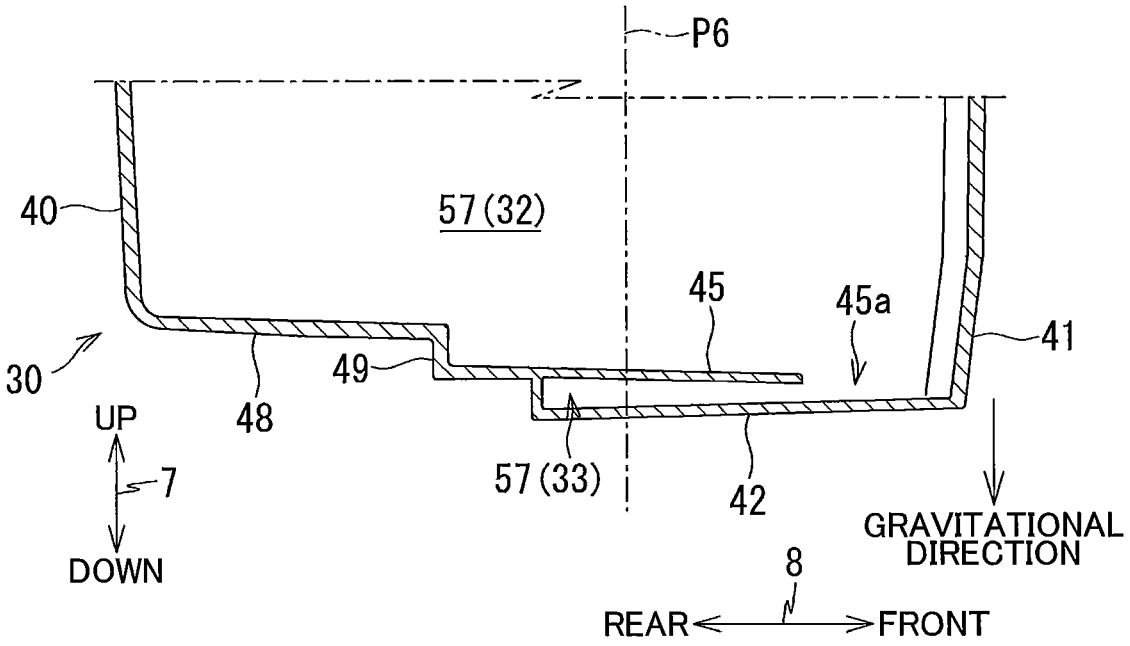
FIG. 10B is a cross-sectional view of the ink cartridge according to the embodiment taken along a plane IV-IV shown in FIG. 10A.

Further, as illustrated in FIGS. 10A and 10B, the communication opening 45*a* is positioned upward (frontward in the operable posture) relative to the position P6, i.e., the liquid level provided by the predetermined maximum amount of ink in the storage chamber 57 in the state where the multifunction peripheral 10 is in the rotated posture. Accordingly, in the rotated posture, the ink stored in the storage chamber 32 (upper portion of the storage chamber 57) does not enter into the storage chamber 160, while only the ink stored in the storage chamber 33 and ink valve chamber 35 (lower portion of the storage chamber 57) is allowed to flow into the storage chamber 160. This structure of the present embodiment can reduce the amount of ink that may enter into the storage chamber 160 from the storage chamber 57 at the time of displacement of the multifunction peripheral 10 into the rotated posture from the operable posture.

[Modifications and Variations]

While the description has been made in detail with reference to the embodiment thereof, it would be apparent to those skilled in the art that many modifications and variations may be made therein without departing from the scope of the disclosure.

[Modification 1]

In the embodiment, the through-hole 94 of the wall 93 defining the air valve chamber 36 of the ink cartridge 30 is sealed by the semipermeable membrane 80, and the through-hole 119 of the storage chamber 160 of the tank 103 is sealed by the semipermeable membrane 118. However, these semipermeable membranes 80 and 118 may not be provided.

In a configuration where the semipermeable membranes 80 and 118 are dispensed with, the passage resistances at the through-holes 94 and 119 may be approximated to zero. Hence, the withstand pressure of the meniscus formed at the communication opening 45*a* may satisfy an inequality (1) shown below:

$$Pm<\rho\cdot Hs\cdot g-Ic\cdot Rn \qquad \text{inequality (1)},$$

where:

Pm: withstand pressure of the meniscus at the communication opening 45*a;*

ρ: density of the liquid;

Hs: length (distance) in the up-down direction 7 between the liquid level of the liquid in the storage chamber 160 at the prescribed position P2 and the communication opening 45*a;* g: gravitational acceleration;

Ic: flow rate of the liquid flowing into the storage chamber 160 from the storage chamber 57 when the liquid surface of the ink in the storage chamber 57 is at the communication opening 45*a* and the liquid surface of the ink in the storage chamber 160 is located at the prescribed position P2 in the up-down direction 7; and Rn: passage resistance at the internal space 117 of the ink needle 102.

As in the depicted embodiment, the meniscus formed at the communication opening 45*a* can be reliably broken by a time when the liquid surface of the ink in the storage chamber 160 reaches the position P2.

<Modification 2>

In the depicted embodiment, the pivoting member 50 is configured to change its posture when the liquid surface of the liquid stored in the storage chamber 160 reaches the position P2 which is below the position corresponding to the communication opening 45*a* of the ink cartridge 30 in the up-down direction 7.

Figure 11:
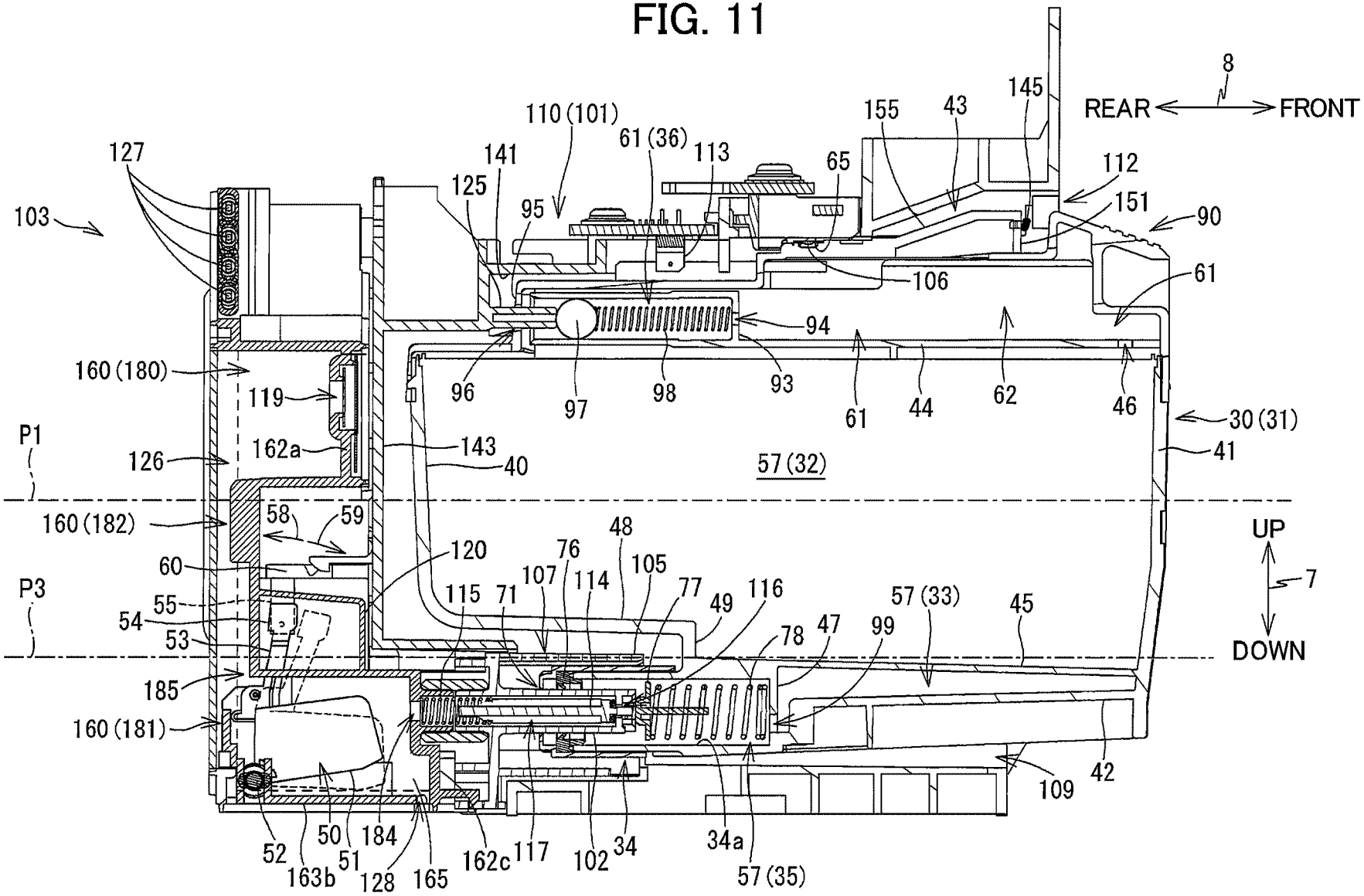
FIG. 11 is a vertical cross-sectional view illustrating a state where an ink cartridge is attached to a cartridge-attachment portion according to a second modification to the embodiment.

However, as depicted in FIG. 11, the pivoting member 50 may be configured to change its posture when the liquid surface of the liquid stored in the storage chamber 160 reaches a prescribed position P3 higher than the position corresponding to the communication opening 45*a* of the ink cartridge 30 in the up-down direction 7.

In this configuration, the liquid level of the ink in the storage chamber 57 is still above the communication opening 45*a* in the ink cartridge 30 when the pivoting member 50 starts to pivot and the signal outputted from the liquid-level sensor 55 changes from low level to high level. Hence, the meniscus formed at the communication opening 45*a* does not affect the liquid level of ink depending on which the signal outputted from the liquid-level sensor 55 changes.

The ink may be still ejected from the recording head 21 after the signal outputted from the liquid-level sensor 55 has changed from low level to high level. In accordance with the consumption of the ink at the recording head 21, the liquid level of the ink in the storage chamber 57 of the ink cartridge 30 may be lowered. Hence, there still remains a possibility that a meniscus may be formed at the communication opening 45*a*. In this case, the withstand pressure of the meniscus may satisfy a following inequality (3):

$$Pm<\rho\cdot Hc\cdot g-Ic\cdot Rn \qquad \text{inequality (3)},$$

where:

Pm: withstand pressure of the meniscus at the communication opening 45*a;*

ρ: density of the liquid;

Hc: length (distance) between the ink supply port 71 and the communication opening 45*a* in the up-down direction 7;

g: gravitational acceleration;

Ic: flow rate of the liquid flowing into the storage chamber 160 from the storage chamber 57 when the liquid surface of the ink in the storage chamber 57 is located at the communication opening 45*a* and the liquid surface of the ink in the storage chamber 160 is located at the prescribed position P3 in the up-down direction 7; and Rn: passage resistance at the internal space 117 of the ink needle 102.

Note that, as in the modification 1, the semipermeable membranes 80 and 118 are assumed not to be provided in this modification.

The withstand pressure of the meniscus at the communication opening 45*a* (Pm) is smaller than a difference between the water head difference when the liquid level in the storage chamber 57 is at the communication opening 45*a* and the liquid surface in the storage chamber 160 is at the ink supply port 71 (ρ·Hc·g) and a product of the passage resistance at the internal space 117 of the ink needle 102 (Rn) and the flow rate of the liquid flowing into the storage chamber 160 from the storage chamber 57 when the above water head difference is generated (Ic).

With this configuration, even if a meniscus is formed at the communication opening 45*a*, the meniscus can be reliably broken by a time when the liquid surface of the ink in the storage chamber 160 reaches the ink supply port 71. Accordingly, the ink is less likely to remain in the lower portion of the ink stored in the storage chamber 57 at the time of replacement of the ink cartridge 30.

Note that, in the above inequality (3), the Hc, (i.e., the length (distance) between the ink supply port 71 and the communication opening 45*a* in the up-down direction 7") may represent a shortest distance between the ink supply port 71 and the communication opening 45*a* in the vertical direction (i.e., a distance between a lowermost edge of the communication opening 45*a* and the upper edge of the ink supply port 71 in the vertical direction), but may not necessarily represent the shortest distance therebetween. For example, the Hc may represent a distance between a center of the communication opening 45*a* and the center the ink supply port 71 in the vertical direction.

<Other Variations>

In the depicted embodiment, the communication port 128 is positioned frontward relative to the buffer chamber 180 in the front-rear direction 8, as illustrated in FIG. 5. However, the front end of the buffer chamber 180 may be positioned further frontward than the communication port 128. That is, the air communication space of the storage chamber 160 including the buffer chamber 180 may be a space extending frontward up to a position further frontward relative to the communication port 128 in the front-rear direction 8.

Further, in the storage chamber 160 of the depicted embodiment, the buffer chamber 180 and first chamber 181 are designed to protrude further frontward relative to the second chamber 182 in the front-rear direction 8. However, the shape of the storage chamber 160 may not be the same as that illustrated in FIG. 5. For example, the buffer chamber 180 and first chamber 181 may protrude further rearward relative to the second chamber 182 in the front-rear direction 8.

In the depicted embodiment, the cartridge-attachment portion 110 is disposed frontward of the recording head 21 and rightward of the conveying path 17 as illustrated in FIG. 3. However, the cartridge-attachment portion 110 may be disposed rearward relative to the recording head 21, or may be disposed leftward of the conveying path 17.

In the depicted embodiment, the attachment sensor 113 and the liquid-level sensor 55 are optical sensors each having the light-emitting portion and the light-receiving portion. Alternatively, the attachment sensor 113 and the liquid-level sensor 55 may be sensors of a different type from the optical sensor, such as a proximity sensor.

In the embodiment, the controller 130 is configured to detect that the liquid level of the ink stored in the storage chamber 160 falls below the position P2 by the pivotal movement of the pivoting member 50 disposed within the storage chamber 160 of each tank 103. However, the liquid level of the ink stored in the storage chamber 160 may be detected by a mechanism other than the pivoting of the pivoting member 50.

For example, a prism may be disposed at the same height as the position P2 in the storage chamber 160 of each tank 103. Whether or not the liquid level of the ink stored in the storage chamber 160 of the tank 103 is higher than the position P2 may be determined on a basis of a travelling direction of light incident on the prism that may vary depending on whether or not the liquid level is higher than the prism, that is, on a basis of transmission status of the light incident on the prism.

Alternatively, for example, a light-transmission portion may be provided in the storage chamber 160 and an optical sensor may be disposed outside of the storage chamber 160. More specifically, the light-transmission portion may be at least a portion of the walls constituting the tank main body of the tank 103, the portion being formed by material capable of transmitting light and being located at least at the same height as the position P2 in the up-down direction 7. Whether or not the liquid level of the ink stored in the storage chamber 160 of the tank 103 is at the same height as or lower than the position P2 may be determined on a basis of whether or not light incident on the light-transmission portion of the tank 103 may be received at a light-receiving portion of the optical sensor without being attenuated by the ink stored in the storage chamber 160 while passing through the storage chamber 160. Here, whether the light incident on the light-transmission portion of the tank 103 may be received at the light-receiving portion of the optical sensor may vary depending on whether or not the liquid level is higher than a light emitting portion of the optical sensor. That is, whether or not the liquid level of the ink stored in the storage chamber 160 is at a position equal to or lower than the position P2 may be determined based on by how much the light incident on the light-transmission portion of the tank 103 may be attenuated by the ink stored in the storage chamber 160 while passing through the storage chamber 160, that is, based on attenuation status of the light incident on the light-transmission portion of the tank 103. For example, the light-receiving portion may receive the incident light without being attenuated by the ink stored in the storage chamber 160; or may not receive the light attenuated by the ink; or may not receive the incident light at all.

Still alternatively, for example, two electrodes may be disposed in the storage chamber 160 of each tank 103. The two electrodes may be mounted on the substrate 60. One of the two electrodes may have a lower end at a position slightly higher than the position P2, while the other of the two electrodes may have a lower end at a position below the position P2. Whether the liquid level of the ink stored in the storage chamber 160 of the tank 103 is lower than or equal to the position P2 may be determined depending on whether or not current flows between the two electrodes through the ink.

In the depicted embodiment, the ink cartridge 30 is configured to be attached to the cartridge-attachment portion 110 by being inserted into the cartridge-attachment portion 110 in the horizontal direction. However, the ink cartridge 30 may be attached to the cartridge-attachment portion 110 by being inserted into the cartridge-attachment portion 110 in a direction other than the horizontal direction, for example, in the up-down direction 7.

Still further, the connecting portion 107 of the cartridge-attachment portion 110 and the ink supply portion 34 of the ink cartridge 30 both extend in the horizontal direction in the above-described embodiment. However, the connecting portion 107 and the ink supply portion 34 may extend in a direction other than the horizontal direction. For example, the connecting portion 107 may protrude upward from the case 101, while the ink supply portion 34 may protrude downward from the bottom wall of the ink cartridge 30. Incidentally, in this case, the position P2 may be set at a center of the connecting portion 107 in the up-down direction 7 or at a center of the ink supply portion 34 in the up-down direction 7, for example.

While the communication opening 45*a* of the embodiment has a generally rectangular shape in a top view, the communication opening 45*a* may have an outer shape other than the rectangular shape. For example, the communication opening 45*a* may have a triangular shape, a pentagonal shape or other polygonal shape in a top view.

Ink serves as an example of liquid in the depicted embodiment. However, instead of the ink, a pretreatment liquid that is ejected onto the sheet prior to the ink during an image recording operation, for example, may be stored in the ink cartridge 30 and the tank 103. Alternatively, water that is used for cleaning the recording head 21 may be stored in the ink cartridge 30 and the tank 103.

The depicted embodiment and various modifications thereof described above may be combined appropriately.

<Remarks>

The multifunction peripheral 10 is an example of an image-recording apparatus. The ink cartridge 30 is an example of a cartridge. The ink is an example of liquid. The tank 103 is an example of a tank. The storage chamber 57 is an example of a first storage chamber. The air communication port 96, air flow path 61, ink buffer chamber 62, through-hole 94, and through-hole 46 are an example of a first air communication portion. The ink supply port 71 is an example of a liquid supply port. The storage chamber 160 is an example of a second storage chamber. The communication port 184 is an example of a liquid inlet port. The air flow path 147, air communication port 124, through-hole 119 and the semipermeable membrane 118 are an example of a second air communication portion. The communication port 128 is an example of a liquid outlet port. The recording head 21 is an example of a recording head. The nozzles 29 are an example of a nozzle. The connecting portion 107 is an example of a connecting portion. The internal space 117 of the ink needle 102 is an example of the first liquid channel. The ink tube 20 is an example of a second liquid channel. The liquid-level sensor 55 and controller 130 are an example of a detector. The inner surface of the step wall 49 is an example of an inner partitioning surface. The inner bottom wall 45 is an example of a wall portion. The communication opening 45*a* is an example of a communication opening. The storage chamber 32 is an example of an upper space of the first storage chamber, and the storage chamber 33 and ink valve chamber 35 are an example of a lower space of the first storage chamber. The semipermeable membrane 80 is an example of a first semipermeable membrane. The semipermeable membrane 118 is an example of a second semipermeable membrane. The position P2 and position P3 are examples of a prescribed position. The position P1 is an example of a maximum liquid level by a predetermined maximum amount of liquid that can be stored in the second storage chamber. The position P6 is an example of a liquid level provided by a predetermined maximum amount of liquid that can be stored in the first storage chamber in the rotated posture of the image-recording apparatus. The frontward direction is an example of a first direction. The rearward direction is an example of a second direction.

What is claimed is:

1. An image-recording apparatus comprising:

a cartridge comprising:

a first storage chamber storing liquid;

a liquid supply port through which the liquid in the first storage chamber is allowed to be supplied; and a first air communication portion configured to allow the first storage chamber to communicate with an atmosphere;

a tank comprising:

a liquid inlet port in communication with the first storage chamber through the liquid supply port;

a second storage chamber in communication with the liquid inlet port and configured to store the liquid supplied from the first storage chamber through the liquid inlet port;

a liquid outlet port allowing the liquid stored in the second storage chamber to be discharged therefrom; and a second air communication portion configured to allow the second storage chamber to communicate with the atmosphere;

a connecting portion comprising a first liquid channel allowing the liquid to circulate between the liquid supply port and the liquid inlet port;

a recording head in communication with the liquid outlet port through a second liquid channel, the recording head comprising a nozzle configured to eject the liquid supplied from the liquid outlet port through the second liquid channel; and a detector configured to detect whether or not a level of the liquid stored in the second storage chamber comes to a prescribed position, wherein the first storage chamber is defined by inner surfaces including an inner partitioning surface positioned close to the tank, the first storage chamber being partitioned by a wall portion into an upper space above the wall portion and a lower space below the wall portion, the wall portion extending from the inner partitioning surface in a first direction away from the tank, the wall portion being formed with a communication opening through which the upper space and the lower space communicate with each other;

wherein the liquid supply port is in communication with the lower space of the first storage chamber;

wherein the prescribed position of the liquid to be detected by the detector is positioned between the communication opening and the liquid supply port in a vertical direction; and wherein a following inequality (1) is satisfied:

$$Pm<\rho\cdot Hs\cdot g-Ic\cdot Rn \qquad \text{inequality (1)},$$

in which:

Pm: withstand pressure of a meniscus of the liquid formed at the communication opening;

P: density of the liquid;

Hs: length in the vertical direction between the prescribed position of the liquid level detected by the detector and the communication opening;

g: gravitational acceleration;

Ic: flow rate of the liquid flowing from the first storage chamber to the second storage chamber when a level of the liquid in the first storage chamber is at the communication opening and the level of the liquid in the second storage chamber is at the prescribed position; and Rn: passage resistance at the first liquid channel.

2. The image-recording apparatus according to claim 1, further comprising:

a first semipermeable membrane positioned at the first air communication portion and configured to block communication of the liquid and to allow communication of atmospheric air; and a second semipermeable membrane positioned at the second air communication portion and configured to block communication of the liquid and to allow communication of the atmospheric air, wherein a following inequality (2) is satisfied:

$$Pm<\rho Hsg-Ic(Rn-Rc+Rs) \qquad \text{inequality (2)},$$

in which:

Pm: withstand pressure of a meniscus of the liquid formed at the communication opening;

P: density of the liquid;

Hs: length in the vertical direction between the prescribed position of the liquid level detected by the detector and the communication opening;

g: gravitational acceleration;

Ic: flow rate of the liquid flowing from the first storage chamber to the second storage chamber when a level of the liquid in the first storage chamber is at the communication opening and the level of the liquid in the second storage chamber is at the prescribed position;

Rn: passage resistance at the first liquid channel;

Rc: passage resistance at the first semipermeable membrane; and

Rs: passage resistance at the second semipermeable membrane.

3. The image-recording apparatus according to claim 1, further comprising:

a first semipermeable membrane positioned at the first air communication portion and configured to block communication of the liquid and to allow communication of atmospheric air; and a second semipermeable membrane positioned at the second air communication portion and configured to block communication of the liquid and to allow communication of the atmospheric air, wherein the first semipermeable membrane provides a passage resistance lower than a passage resistance provided by the second semipermeable membrane.

4. The image-recording apparatus according to claim 1, wherein the communication opening is polygonal in shape.

5. The image-recording apparatus according to claim 1, wherein the prescribed position of the liquid detected by the detector is at a center of the liquid supply port in the vertical direction.

6. The image-recording apparatus according to claim 1, wherein the second storage chamber is positioned further in the first direction relative to the nozzle, wherein the second storage chamber includes a liquid-storage space and an air-communication space, the liquid-storage space being defined as a space positioned below a maximum liquid level provided by a predetermined maximum amount of liquid that can be stored in the second storage chamber, the air-communication space being defined as a space positioned above the maximum liquid level;

wherein the liquid inlet port and the liquid outlet port are in communication with the liquid-storage space; and wherein the air-communication space of the second storage chamber has a prescribed portion positioned further in a second direction opposite to the first direction relative to the liquid outlet port, the prescribed portion of the air-communication space of the second storage chamber having a volume greater than a sum of a volume of the lower space of the first storage chamber and a volume of a portion of the liquid-storage space positioned further in the first direction relative to the liquid outlet port.

7. The image-recording apparatus according to claim 1, wherein the communication opening is positioned above a liquid level provided by a predetermined maximum amount of liquid that can be stored in the first storage chamber in a state where the image-recording apparatus is disposed in such an orientation that the inner partitioning surface faces upward in the vertical direction.

8. The image-recording apparatus according to claim 1, wherein the recording head is movable independently of the tank and the cartridge.

9. The image-recording apparatus according to claim 1, wherein the first storage chamber has a lowermost wall that is positioned lower than the liquid inlet port of the tank.

10. An image-recording apparatus comprising:

a cartridge comprising:

a first storage chamber storing liquid;

a liquid supply port through which the liquid in the first storage chamber is allowed to be supplied; and a first air communication portion configured to allow the first storage chamber to communicate with an atmosphere;

a tank comprising:

a liquid inlet port in communication with the first storage chamber through the liquid supply port;

a second storage chamber in communication with the liquid inlet port and configured to store the liquid supplied from the first storage chamber through the liquid inlet port;

a liquid outlet port allowing the liquid stored in the second storage chamber to be discharged therefrom; and a second air communication portion configured to allow the second storage chamber to communicate with the atmosphere;

a connecting portion comprising a first liquid channel allowing the liquid to circulate between the liquid supply port and the liquid inlet port;

a recording head in communication with the liquid outlet port through a second liquid channel, the recording head comprising a nozzle configured to eject the liquid supplied from the liquid outlet port through the second liquid channel; and a detector configured to detect whether or not a level of the liquid stored in the second storage chamber comes to a prescribed position, wherein the first storage chamber is defined by inner surfaces including an inner partitioning surface positioned close to the tank, the first storage chamber being partitioned by a wall portion into an upper space above the wall portion and a lower space below the wall portion, the wall portion extending from the inner partitioning surface in a first direction away from the tank, the wall portion being formed with a communication opening through which the upper space and the lower space communicate with each other;

wherein the liquid supply port is in communication with the lower space of the first storage chamber;

wherein the prescribed position of the liquid to be detected by the detector is positioned higher than the communication opening in a vertical direction; and wherein a following inequality (3) is satisfied:

$$Pm < \rho \cdot Hc \cdot g - Ic \cdot Rn \quad \text{inequality (3)},$$

in which:

Pm: withstand pressure of a meniscus of the liquid formed at the communication opening;

P: density of the liquid;

Hc: length in the vertical direction between the liquid supply port and the communication opening;

g: gravitational acceleration;

Ic: flow rate of the liquid flowing from the first storage chamber to the second storage chamber when a level of the liquid in the first storage chamber is at the communication opening and the level of the liquid in the second storage chamber is at the prescribed position; and Rn: passage resistance at the first liquid channel.

11. The image-recording apparatus according to claim 10, wherein the second storage chamber is positioned further in the first direction relative to the nozzle, wherein the second storage chamber includes a liquid-storage space and an air-communication space, the liquid-storage space being defined as a space positioned below a maximum liquid level provided by a predetermined maximum amount of liquid that can be stored in the second storage chamber, the air-communication space being defined as a space positioned above the maximum liquid level;

wherein the liquid inlet port and the liquid outlet port are in communication with the liquid-storage space;

wherein the air-communication space of the second storage chamber has a prescribed portion positioned further in a second direction opposite to the first direction relative to the liquid outlet port, the prescribed portion of the air-communication space of the second storage chamber having a volume greater than a sum of a volume of the lower space of the first storage chamber and a volume of a portion of the liquid-storage space positioned further in the first direction relative to the liquid outlet port.

12. The image-recording apparatus according to claim 10, wherein the communication opening is positioned above a liquid level provided by a predetermined maximum amount of liquid that can be stored in the first storage chamber in a state where the image-recording apparatus is disposed in such an orientation that the inner partitioning surface faces upward in the vertical direction.

13. The image-recording apparatus according to claim 10, wherein the recording head is movable independently of the tank and the cartridge.

14. The image-recording apparatus according to claim 10, wherein the first storage chamber has a lowermost wall that is positioned lower than the liquid inlet port of the tank.

* * * * *